US008696429B1

(12) United States Patent
White

(10) Patent No.: US 8,696,429 B1
(45) **Date of Patent: *Apr. 15, 2014**

(54) METHOD AND APPARATUS FOR A WAGERING GAME WITH INDICIA DEVELOPED PAYLINES

(71) Applicant: Primo Innovo LLC, Glenview, IL (US)

(72) Inventor: Michael L. White, Glenview, IL (US)

(73) Assignee: Primo Innovo, LLC, Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/743,479

(22) Filed: Jan. 17, 2013

Related U.S. Application Data

(63) Continuation-in-part of application No. 13/506,682, filed on May 9, 2012, now Pat. No. 8,398,477, which is a continuation-in-part of application No. 12/221,909, filed on Aug. 7, 2008, now Pat. No. 8,287,353.

(51) Int. Cl.
*A63F 9/24* (2006.01)

(52) U.S. Cl.
USPC ..... 463/16; 463/25

(58) Field of Classification Search
USPC ..... 463/16–20
See application file for complete search history.

(56) References Cited

U.S. PATENT DOCUMENTS

| | | | | |
|---|---|---|---|---|
| 5,931,467 | A * | 8/1999 | Kamille | 273/139 |
| 7,419,431 | B2 * | 9/2008 | Gauselmann et al. | 463/30 |
| 2004/0166929 | A1 * | 8/2004 | Tarantino | 463/22 |
| 2005/0255903 | A1 * | 11/2005 | Jackson | 463/16 |
| 2008/0045321 | A1 * | 2/2008 | Kato | 463/20 |
| 2009/0156295 | A1 * | 6/2009 | Demsetz et al. | 463/20 |

* cited by examiner

*Primary Examiner* — Tramar Harper
(74) *Attorney, Agent, or Firm* — Michael L. White

(57) ABSTRACT

In contrast to slot-type gaming machines with their preset paylines designating predetermined array positions, the paylines of this novel wagering game are unknown until the indicia in the array have been selected. The indicia are selected from a variety of indicium types, each having a different number of members for identifying adjacent indicia. The randomly selected indicia determine the paylines, if any, in the array. Conditions may be imposed that limit the size and geometry of the paylines in this wagering game.

20 Claims, 21 Drawing Sheets

600

| PAY TABLE | |
|---|---|
| WINNING SYMBOL COMBINATIONS ANY INDICIA ORIENTATION 610 | INDICIA PAYLINE PAYS 620 |
|  | 10 |
|  | 10 |
|  | 5 |
|  | 3 |
|  | 5 |
|  | 2 |
|  | 1 |

1000

| PAY TABLE | | | |
|---|---|---|---|
| WINNING SYMBOL COMBINATIONS 1010 | INDICIA PAYLINE PAYS 1020 | PRESET PAYLINE PAYS 1030 | |
| | | SAME ANGLE 1032 | DIFFERENT ANGLES 1034 |
| | 5 | 3 | 1 |
| | 10 | N/A | N/A |
| | 5 | N/A | N/A |
| | 3 | 5 | 2 |
| | 5 | N/A | N/A |
| | 2 | 5 | 3 |
| | 1 | 5 | N/A |
| | N/A | 10 | N/A |

*FIG. 10*

1200

| INDICIA PROBABILITY TABLE | |
|---|---|
| RANDOM NUMBER 1210 | CORRESPONDING INDICIA 1220 |
| 00 | |
| 01 | |
| 02 | |
| 03 | |
| 04 | |
| 05 | |
| 06 | |
| 07 | |
| 08 | |
| 09 | |
| 10 | |

*FIG. 12*

1300

| ANGULAR CHANGE PROBABILITY TABLE | |
|---|---|
| RANDOM NUMBER 1310 | ANGULAR CHANGE (DEGREES) 1320 |
| 00 | 0 |
| 01 | 90 |
| 02 | 180 |
| 03 | 270 |

*FIG. 13*

1500

| INDICIA SYMBOL PROBABILITY TABLE | | | | INDICIA SYMBOL PROBABILITY TABLE | | | |
|---|---|---|---|---|---|---|---|
| RANDOM NUMBER 1510 | CORRESPONDING INDICIA 1520 | SYMBOL SUIT | SYMBOL RANK | RANDOM NUMBER 1510 | CORRESPONDING INDICIA 1540 | SYMBOL SUIT | SYMBOL RANK |
| 00 | | ♣ | A | 11 | | ♣ | K |
| 01 | | ♣ | A | 12 | | ♣ | K |
| 02 | | ♣ | A | 13 | | ♣ | K |
| 03 | | ♣ | A | 14 | | ♣ | K |
| 04 | | ♣ | A | 15 | | ♣ | K |
| 05 | | ♣ | A | 16 | | ♣ | K |
| 06 | | ♣ | A | 17 | | ♣ | K |
| 07 | | ♣ | A | 18 | | ♣ | K |
| 08 | | ♣ | A | 19 | | ♣ | K |
| 09 | | ♣ | A | 20 | | ♣ | K |
| 10 | | ♣ | A | 21 | | ♣ | K |

1530

1550

*FIG. 15*

PAY TABLE

3-CARD POKER

1600

| CARD HAND 1610 | PAYS 1620 |
|---|---|
| ROYAL FLUSH | 10 |
| STRAIGHT FLUSH | 5 |
| THREE OF A KIND | 4 |
| STRAIGHT | 3 |
| FLUSH | 2 |
| PAIR | 1 |

*FIG. 16*

3-CARD POKER

INDICIA COMBINATION FACTOR TABLE

| INDICIA COMBINATION 1710 | FACTOR 1720 |
|---|---|
|  | 2.0 |
|  | 1.5 |
|  | 1.4 |
|  | 1.4 |
|  | 1.2 |
|  | 1.3 |
|  | 1.2 |
|  | 1.1 |
|  | 1.0 |

1900

| SYMBOL PROBABILITY TABLE | |
|---|---|
| RANDOM NUMBER 1910 | CORRESPONDING SYMBOL 1922 1920 |
| 00 | ♠ |
| 01 | ♣ |
| 02 | ♦ |
| 03 | ♥ |
| 04 | $ |

*FIG. 19*

METHOD AND APPARATUS FOR A WAGERING GAME WITH INDICIA DEVELOPED PAYLINES

The present application is a continuation-in-part of U.S. patent application Ser. No. 13/506,682, entitled "Method and Apparatus for a Wagering Game with Indicia Developed Paylines," filed on May 9, 2012, and which issued as U.S. Pat. No. 8,398,477 on Mar. 19, 2013; which is a continuation-in-part of U.S. patent application Ser. No. 12/221,909, entitled "Method and Apparatus for a Wagering Game with Indicia Developed Paylines," filed on Aug. 7, 2008, and issued as U.S. Pat. No. 8,287,363 on Oct. 16, 2012. The above referenced applications are hereby incorporated by reference in their entirety.

FIELD OF THE INVENTION

This invention relates to gaming, and more particularly, in one embodiment, to wagering games played on video gaming machines.

BACKGROUND OF THE INVENTION

Gaming machines are a popular form of entertainment with gaming establishment patrons. Slot type gaming machines form an array of randomly selected indicia. These games traditionally use preset paylines to indicate predetermined array positions, which, if filled with winning combinations of indicia, provide a winning game outcome.

SUMMARY OF THE INVENTION

In one embodiment, the wagering game may be broadly described as a slot type wagering game with indicia developed paylines. A wagering game with an array of randomly selected indicia is presented to the player after a wager is placed. Furthermore, each indicium in the array has a randomly determined angular orientation and a randomly determined number of members for indicating linkage to adjacent indicia. In one embodiment, when the member of one indicium is in alignment with the member of another indicium, a link is formed between those indicia. Several indicia may link together forming a payline. A winning game outcome occurs when the indicia forming the payline satisfies predetermined requirements.

BRIEF DESCRIPTION OF THE FIGURES

Various embodiments of the wagering game are described and illustrated in the accompanying figures. The figures are provided as examples only and are not intended to be considered as limitations to the invention. Similarly, numerical entries only represent exemplary information, and those skilled in the art understand that a variety of different values and alternate arrangements can be made. Consequently, the wagering game is illustrated by way of example and not by limitation in the accompanying figures in which:

FIG. 10 is an exemplary pay table for the exemplary wagering game embodiment of FIG. 9;

FIG. 12 is an exemplary indicia probability table for randomly determining an indicium for an array position in one embodiment of the wagering game;

FIG. 13 is an exemplary angular change probability table for randomly determining the change in angular orientation of an indicium in an array position in one embodiment of the wagering game;

FIG. 15 is an exemplary indicia and symbol probability table for randomly determining an indicium and its associated symbol in one embodiment of the wagering game;

FIG. 16 is an exemplary pay table for winning symbol combinations for a three-card Poker game;

FIG. 19 is an exemplary symbol probability table for randomly determining a symbol for association with an indicium in one embodiment of the wagering game;

DETAILED DESCRIPTION

The wagering game described in the following embodiments may be adapted for play on gaming machines similar to those found in gaming establishments. Gaming establishments commonly network gaming machines into a gaming system to facilitate the monitoring and support of each gaming machine in the system.

Figure 1:
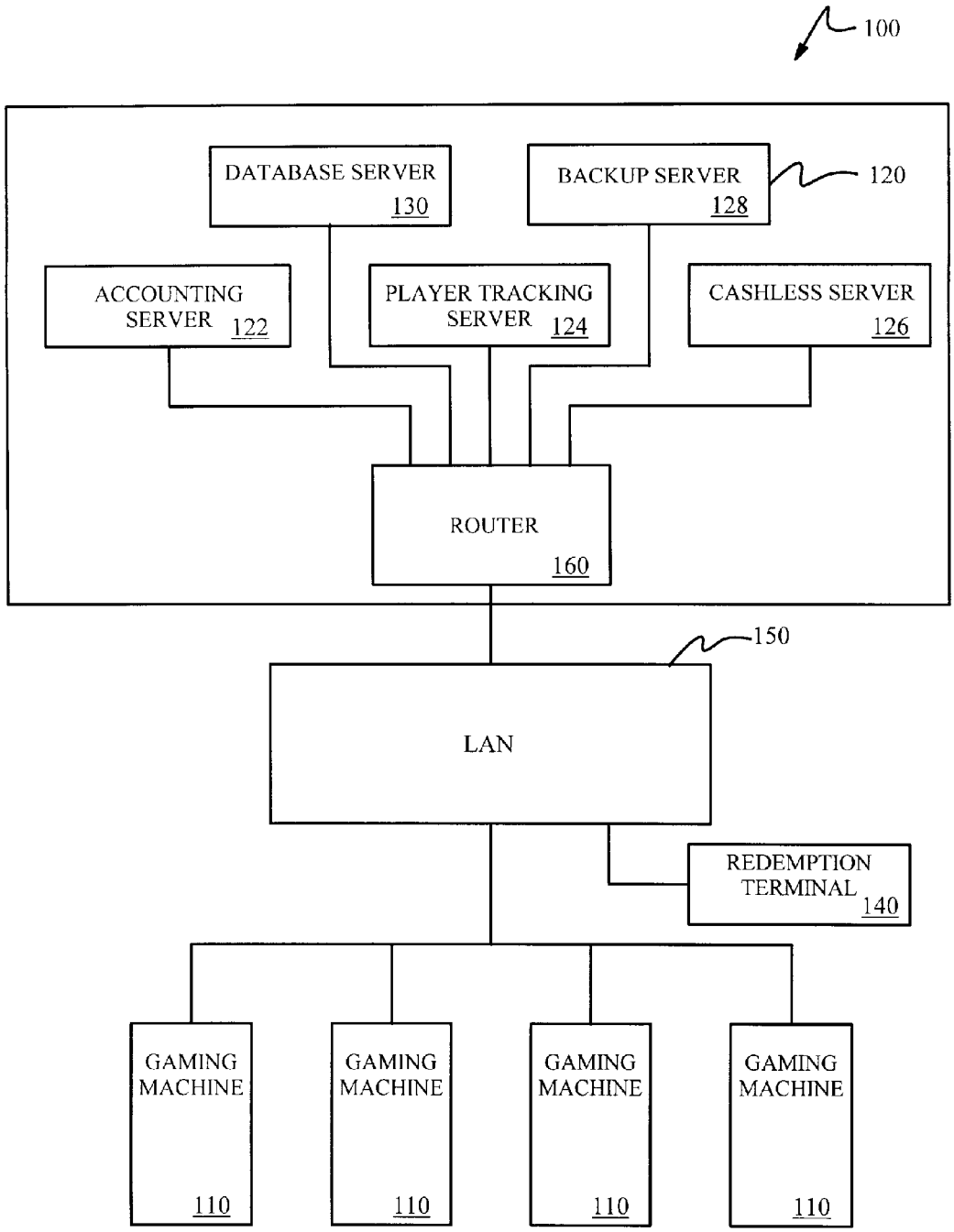
FIG. 1 is an exemplary block diagram of a gaming system.

Referring to FIG. 1, an exemplary gaming system 100 typically found in a gaming establishment is illustrated. Gaming machines 110 on the floor of a gaming establishment are usually in communication with a number of servers 120 that provide ancillary support services for wagering activity at each gaming machine. Other network devices such as routers 160, storage devices (e.g., a database server 130), and backup servers 128 may also be part of the gaming system 100.

These servers 120, and the gaming machines 110 they communicate with, are connected in a communications network (e.g., a local area network (LAN) 150) electronically linking the gaming system 100 together. Although it is common practice to use several different servers, each dedicated to particular gaming functions, it is also possible to bundle these different gaming functions for execution on a single server. Servers 120 commonly found in some gaming systems include: an accounting server 122 (to record wagers and payouts), a player-tracking server 124 (to track wagering activity of individual players), and a cashless server 126 (to assist with the issue and redemption of wagering vouchers).

The player-tracking server maintains a record of the player's wagering activity, allowing the gaming establishment to reward gaming patrons commensurate with their wagering activity. A player-tracking card is commonly provided to gaming patrons for participation in player loyalty programs sponsored by the gaming establishment. The player-tracking card is encoded with a unique player identification number that allows the player-tracking server to maintain a record of player wagering activity.

The cashless server maintains a record of issued vouchers. Vouchers are typically paper tickets with an imprinted monetary value that facilitates wagering. These vouchers are printed and accepted by gaming machines 110 to allow players to make wagers and cash out of the gaming machine. Each voucher has a unique barcode identifier that acts as an index to a database for retrieving information regarding the voucher (e.g., the specific monetary value of the voucher). Typically, the cashless server 126 stores this information in its database for recall when the voucher is presented for redemption.

When presented to a gaming machine 110, the barcode information is communicated to the cashless server 126, and the voucher is validated by the cashless server 126. The voucher value is then communicated to the gaming machine, and the value of the voucher credited for play on the gaming machine.

Other gaming related devices in the gaming system 100 may be present and in communication with the local area network 150. For example, a redemption terminal 140 (e.g., such as a computer terminal for a cashier or a self serve kiosk) may be available to allow a player to cash out a voucher. This redemption terminal 140 is typically in communication with the cashless server 126 to facilitate monetary transactions.

The gaming machines 110, servers 120, and other network devices typically use serial communication protocols for transferring data over the gaming system's local area network 150. In other embodiments, gaming systems 100 may use Ethernet type communication protocols or any other communication protocol using any number of different types of communication media (including, e.g., optical fiber, radiofrequency, etc.).

Regardless of whether a single or multiple servers 120 are utilized in the gaming system 100 embodiment illustrated in FIG. 1, in most gaming systems, the gaming machine 110 determines the game outcome and the servers 120 support the wagering and data collection activities of each gaming machine. A game program (i.e., software) controls the gaming machine 110 and is executed with a CPU (i.e., central processing unit or simply processor) in the gaming machine to determine the game outcome.

In other gaming systems, in lieu of executing a game program from a CPU in the gaming machine, the execution of the game program is performed by a CPU in a game server (not shown). For example, in one embodiment, the game server may execute a game program in response to initiation of the wagering game at a gaming machine 110. In this gaming system embodiment, the game server may perform all game program calculations and transmit video data to the gaming machine for display. Player selections may be transmitted from the gaming machine to the gaming server for further execution by the game program.

Alternatively, in still another gaming system embodiment, a CPU in the gaming machine and a CPU in a game server may each execute portions of a game program. For example, the game server may be limited to determining and transmitting random numbers to the gaming machine. The gaming machine uses these random numbers to determine, either directly or indirectly, game outcomes.

The gaming machine 110 illustrated in FIG. 1 is typically either an electro-mechanical gaming machine or a video gaming machine. The electro-mechanical gaming machine has mechanical reels to display game outcomes. In contrast, the video gaming machine has a video display for displaying game outcomes. With the exception of the game presentation (i.e., either mechanical reels or a video display), both types of gaming machines operate using the same basic principles.

Video gaming machines, because of their video display, are adaptable to support many different types of wagering games; including the wagering game described and claimed in this specification. The electromechanical gaming machine may also be adapted to support embodiments of this wagering game; in particular, those electromechanical gaming machines using independent reels to individually display each indicium in the array.

Figure 2:
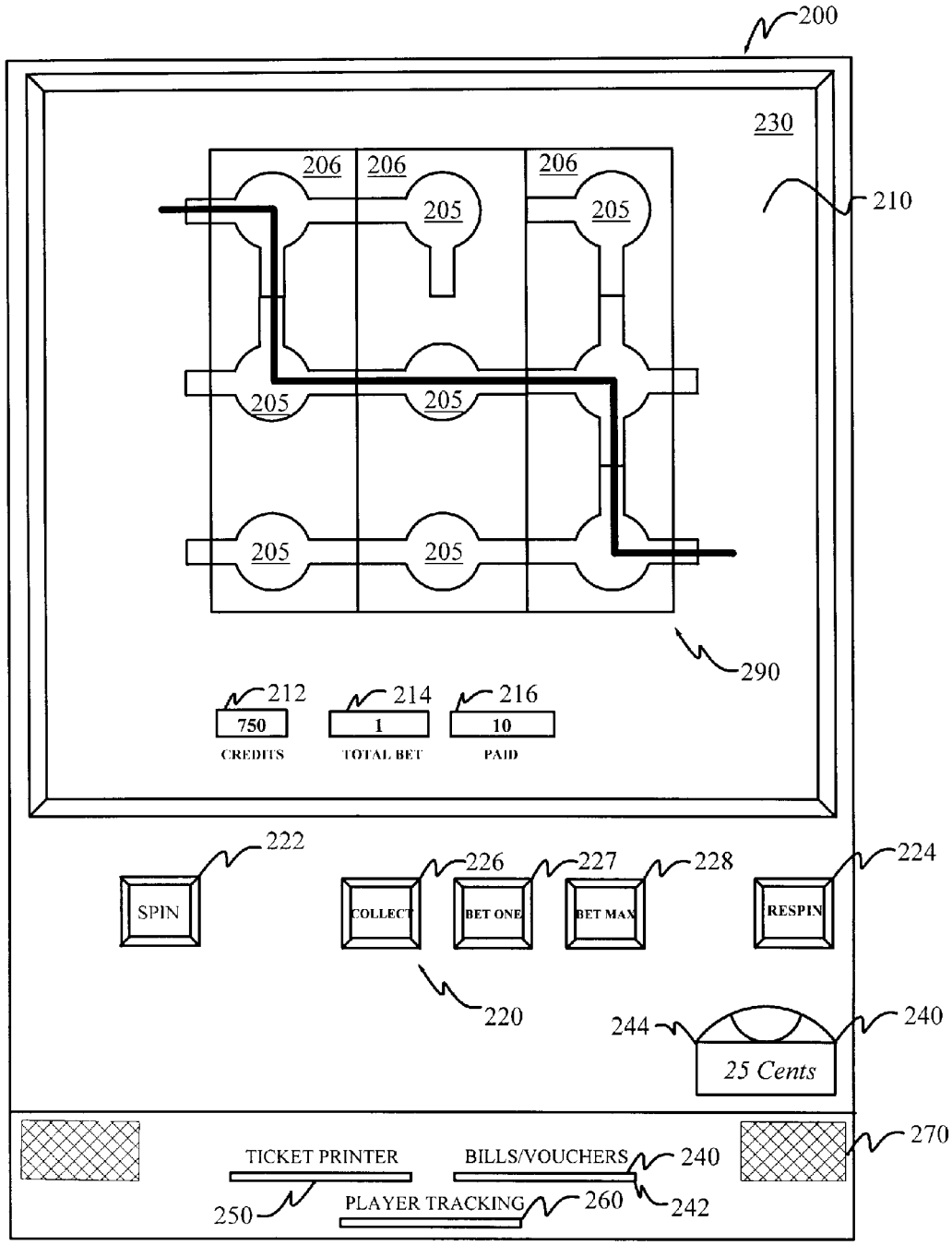
FIG. 2 is an orthogonal view of one embodiment of the gaming machine illustrated in FIG. 1.

FIG. 2 illustrates one embodiment of the gaming machine 110 depicted in FIG. 1. FIG. 2 depicts a video gaming machine 200 specifically adapted for play of the wagering game embodiments described herein. The video gaming machine 200 has a wager acceptor 240 for initiating game play. The wager acceptor 240 may be a bill validator 242 (for accepting paper currency), a coin acceptor 244, or any other device capable of receiving and registering some form of acceptable monetary value. The bill validator 242 may, in some embodiments, also accept vouchers (generally in the form of paper tickets).

As discussed above, vouchers are printed by some video gaming machines 200 in lieu of paying coins when a player cashes out of the gaming machine. The video gaming machine 200, in this embodiment, has a ticket printer 250 which prints a voucher for the value of the cash out from the gaming machine. Typically, the voucher may be redeemed by a video gaming machine 200 by inserting the voucher into the bill validator 242. The bill validator 242 reads the barcode printed on the voucher, communicates with the cashless server to determine the value of the voucher, and credits the video gaming machine 200 for the value of the voucher.

The video gaming machine 200, in some embodiments, may have an alternative or additional payout mechanism such as a coin hopper (not shown on FIG. 2) internal to the gaming machine. The coin hopper dispenses coins to the player when the player cashes out.

The video gaming machine 200 may also include a card reader 260 for reading the player-tracking card discussed above. The card reader 260 reads the player-tracking card and communicates the player's identification number to a player-tracking server.

Game play is initiated when the video gaming machine 200 receives a wager. The wagering game 290, in one embodiment, is displayed on the video display 210 of the video gaming machine 200. The video display 210 is generally a CRT or flat-panel display such as a LED or plasma display. However, any other type of display may be used to present the wagering game 290.

In one embodiment, the wagering game 290 commences with the spinning of the indicia carriers 206 (i.e., reels), either a mechanical reel or a video representation of a reel, to suggest the random selection of an indicium 205 for each array position. In one embodiment, each of the indicia 205 on the reels 206 may also be changing angular orientation as the reel spins. Consequently, in this embodiment, not only does the reel initially spin, but also the indicia on the reel, changing the angular orientation of the indicium 205 in a different plane to the spinning of the reel. In this embodiment, the reels 206 stop and the indicia 205 may continue spinning, slowing to a stop at the predetermined angular orientation randomly determined for each indicium.

The video display 210 may also have a video representation of wagering meters to provide wagering information to the player. The meter display may include: a credit meter 212 (displays total credits available for wagering), total bet meter 214 (displays the number of credits bet on each game), and a paid credit meter 216 (displays payoff credits obtained from a winning game outcome).

In some embodiments, the player may make wagering selections using a pushbutton panel 220. For example, the player may designate the amount wagered on each individual game (e.g., the bet one pushbutton 227 and the bet max pushbutton 228), the start of the game (e.g., the game start pushbutton 222), and the collection of credits on the gaming machine (e.g., using the collect pushbutton 226).

The pushbutton panel 220 may also be used by the player to make game play decisions. For example, a respin pushbutton 224 may be available to allow the player to cause the video gaming machine 200 to randomly change the angular orientation of each indicium in its array position.

The video display 210 may operate, in some embodiments, in conjunction with a touch screen 230. To facilitate the play of a plurality of different games on a single video gaming machine 200, the touch screen 230 may serve as a means for inputting player selections. Icons representing various potential player selections may be presented on the video display 210. The player may touch an icon presented on the video display 210 to implement the corresponding function represented by the icon. In one embodiment the touch screen 230 may be used exclusively to control game play—eliminating the need for a pushbutton panel 220. In other embodiments, a combination of the pushbutton panel 220 and the touch screen 230 may be used to execute the player's game play decisions.

In addition, the video gaming machine 200 may provide sound effects or music to accompany game play through speakers 270. The speakers 270 may also provide game play information (e.g., player audio help).

Figure 3:
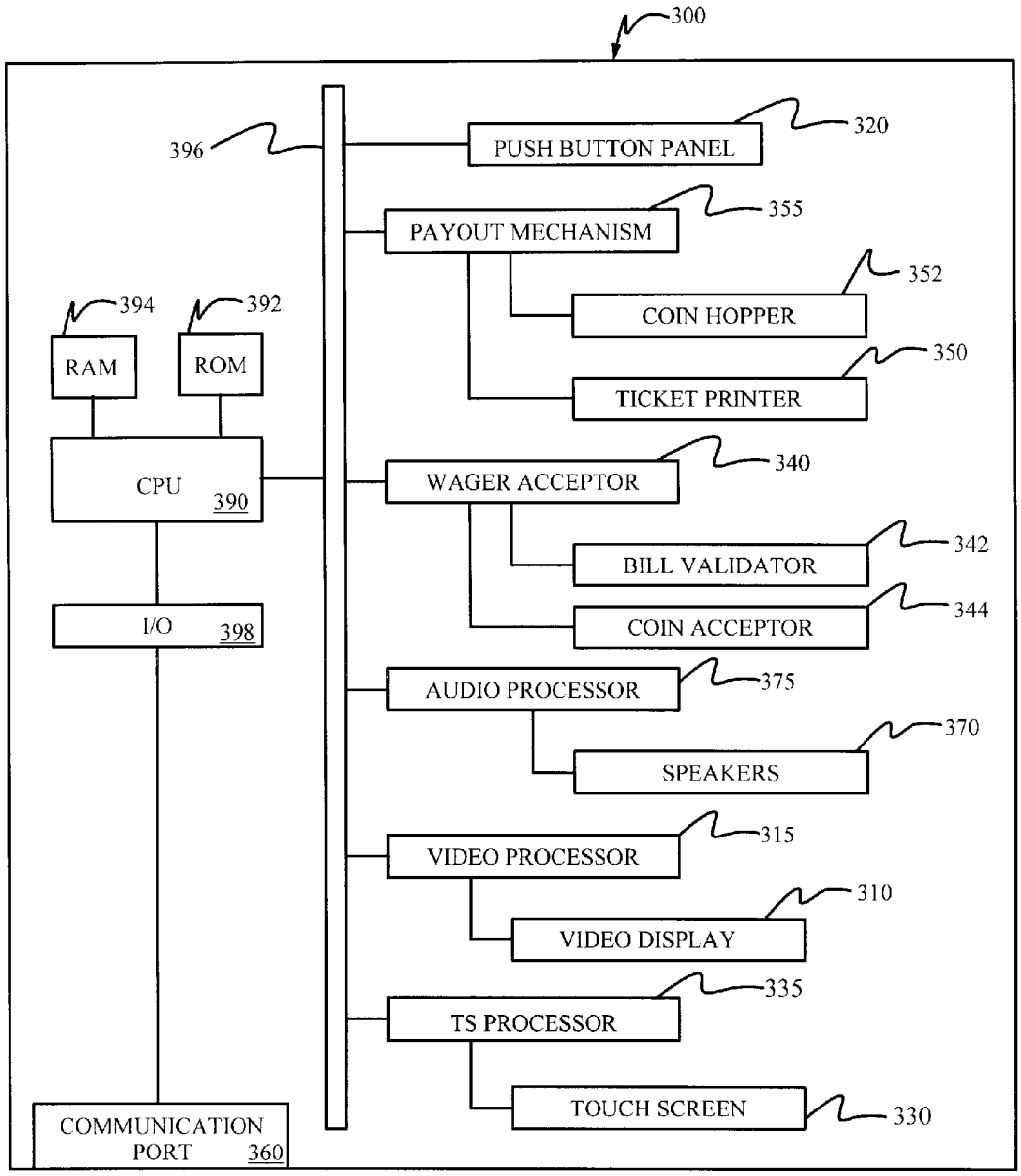
FIG. 3 is an exemplary block diagram of one embodiment of the control system of the gaming machine of FIG. 2.

With reference to FIG. 3, an exemplary control block diagram 300 is provided depicting the operational control of one embodiment of the video gaming machine 200 illustrated in FIG. 2. The central processing unit (i.e., CPU) 390, among other functions, controls the operation of peripheral devices ancillary to the operation of the gaming machine through the execution of the game program.

The CPU 390 has an internal I/O bus 396 to control communications between the CPU and the peripheral devices. The CPU 390 generally controls, either directly or indirectly the bill validator 342 and coin acceptor 344 (more generally known as a wager acceptor 340), the video display 310 (output controlled by video processor 315), the pushbutton panel 320, the coin hopper 352 and ticket printer 350 (more generally known as a payout mechanism 355), speakers 370 (output controlled by audio processor 375), and the touch screen 330 (input monitored by touch screen processor 335).

The CPU 390 not only controls and communicates with peripheral devices inside the gaming machine, but is also in communication with various servers that provide ancillary support services through a communication network as previously discussed. Typically, the CPU 390 also has a second, external I/O bus 398 that exchanges data with the communication network through communication port 360 in the gaming machine.

In addition to controlling each of the gaming machine's peripheral devices, the CPU 390, through the execution of the game program, also controls game play. The gaming machine has non-volatile, read-only memory (ROM) 392, in which the game program is stored; and volatile, random access memory (RAM) 394, from which the game program is executed by the CPU 390.

The game play of the wagering game is displayed by the gaming machine and is typically determined by the CPU 390 which signals the video processor 315 to display an image on the video screen 310. In one embodiment, the CPU 390 randomly selects indicia from an indicia set (e.g., a probability table) by generating a random number with a random number generator (not shown). The random number generator is a mathematical operation executed by the CPU using an initial numeric seed to determine a random number within a predetermined numerical range. The random number determined corresponds to an indicium (or, in another embodiment, with an entire game outcome) listed in a probability table stored in memory, which is then assigned to the game array. With this general background of gaming machine operation, the process for executing the wagering game can now be described.

Figure 4:
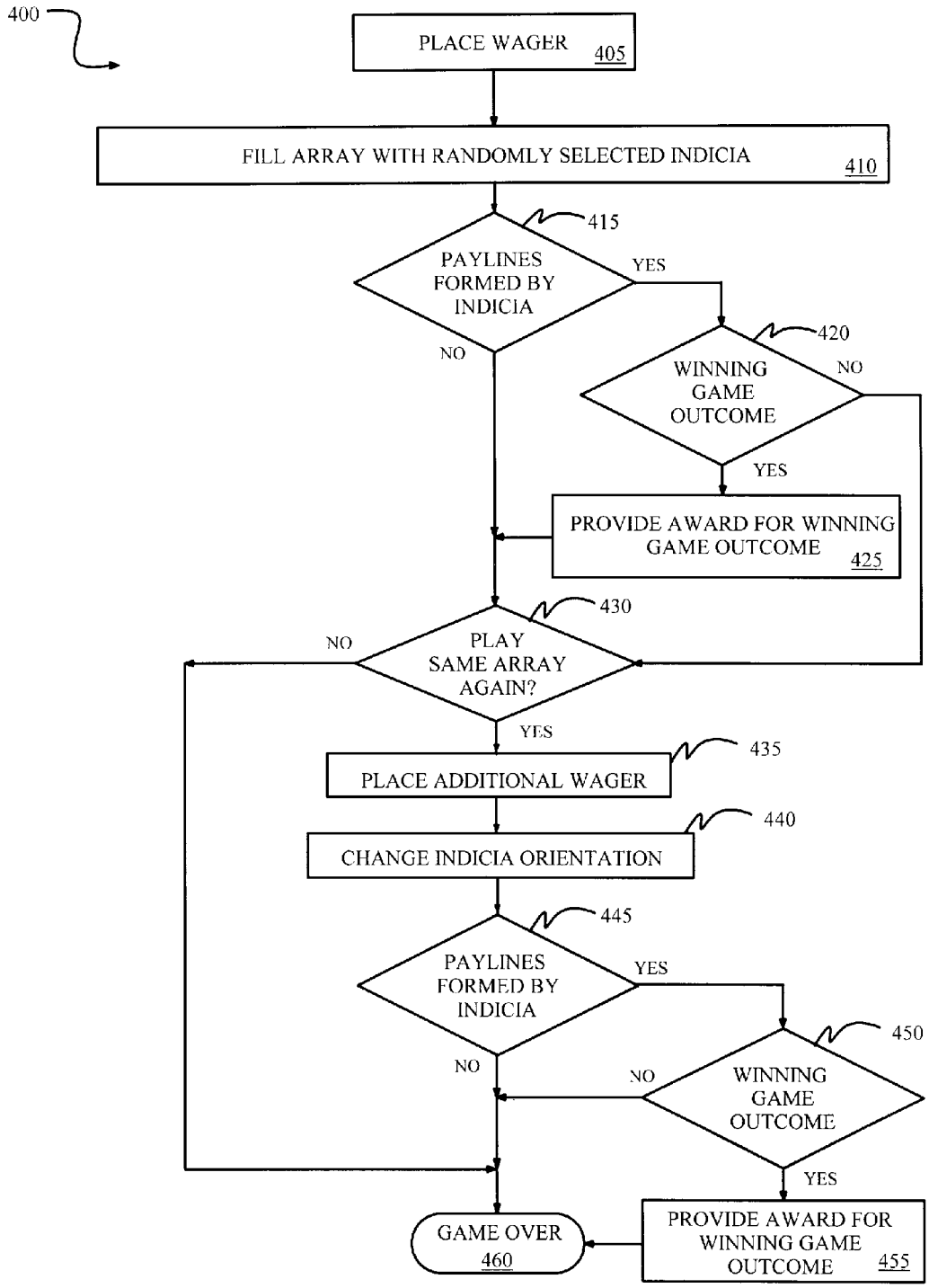
FIG. 4 is an exemplary process flowchart illustrating the game play of one embodiment of the wagering game with a replay feature changing the indicia orientation.

Referring to FIG. 4, the process flowchart 400 provides an overview of one embodiment of the wagering game process. As is generally the case in most slot type gaming machines, the wagering game starts with recognizing a wager in step 405. The gaming machine then forms an array with randomly selected indicia in step 410 with a random number generator in conjunction with an indicia probability table.

Referring to FIG. 12, an exemplary indicia probability table 1200 is illustrated which, in one embodiment, is used to individually select each indicium in the array. Each different indicium type 1220 (i.e., as identified by the number of members associated with the indicium) is represented on the indicia probability table 1200 in each of their potential angular orientations relative to the array.

In addition to indicium types distinguishable by the number of members associated with each indicium, in one embodiment, there are also indicium subtypes identifiable by the relative orientation of the members on the indicium. For example, in the embodiment of FIG. 12, a two-member indicium type may have two different subtypes: one indicium subtype having members at 180 degrees apart and another indicium subtype with members 90 degrees apart. In some embodiments, these two different subtypes are not considered equivalent or otherwise interchangeable for purposes of producing a winning game outcome. In other embodiments, these two indicia subtypes may be considered equivalent for purposes of determining an award amount.

In this embodiment, a random number 1210 for each array position is generated to determine each indicium type 1220 in the game array. A random number generator (not shown) determines a random number 1210 within a given range (in this case, between 0 and 10 inclusive). The random number 1210 generated acts as an index into the probability table 1200, allowing the determination of a corresponding indicium 1220. The corresponding indicium 1220 determined by the random number is then assigned to the array position for which the random number was generated.

As a result, the random number generator in conjunction with the probability table of FIG. 12 selects any of the possible indicia in any of their possible angular orientations, producing a randomly selected indicium with a random angular orientation. This process may be repeated for each of the array positions until the array is filled.

In another embodiment, the indicia probability table 1200 may be weighted by specifying a range of random numbers (not shown) for each of the corresponding indicium types 1220 illustrated in the indicia probability table 1200. The range of random numbers for each of the indicia 1220 may vary to increase the probability of selecting specific indicia.

The gaming machine determines in step 415 whether the randomly selected indicia in the array form paylines. As previously noted, in one embodiment, paylines are formed by indicia linking together which meet one or more payline construction conditions. In another embodiment, the mere linkage of indicia creates a subset of indicia potentially eligible for an award; no conditions are required to be met. In still another embodiment, separate, unlinked groups of linked indicia may all be considered to determine a game outcome, either separately or together.

Linking indicia are pairs of indicia in the array which identify each other (mutually identify) by, in one embodiment, the alignment of members on each of the pair of indicia (i.e., mutually directionally identify). A single indicium, in some embodiments may link with multiple indicia. Several pairs of indicia may link together to form a chain of indicia which may form a payline. In one embodiment, indicia in the array only link with adjacent indicia.

In one embodiment, adjacent indicia may include all indicia in adjacent array positions directly orthogonal to the array position of the indicium. In another embodiment, adjacent indicia may also include indicia in adjacent array positions diagonal to the array position of the indicium. Alternatively, in another embodiment, adjacent indicia may only include indicia in adjacent array positions diagonal to the array position of the indicium. Thus the adjacent array positions may include any of the array positions bounding an array position, including in some embodiments, the diagonally oriented array positions. In more general terms, in one embodiment, adjacent indicia include any indicia to which an indicium could potentially link given the appropriate indicium geometry and orientation.

For embodiments of the wagering game with paylines, the identification of indicia developed paylines may be done in a number of different ways. One approach for identifying paylines in the array is to first search the array for linking indicia and then determine if the linking indicia meet the conditions requisite for forming a payline.

The formation of paylines may be limited, in one embodiment, based on payline construction conditions defining the geometry of valid paylines. For example, conditions may limit the array positions available for forming the payline. In other embodiments, conditions may exist limiting the indicia available for forming the payline. Consequently, the exact methodology used to identify paylines is dependent on the conditions imposed by the wagering game for the formation of paylines.

For example, as noted above, it may be a requirement that all paylines enter and exit from the left and right sides of the array. For this condition, each of the array positions comprising the first column is individually analyzed for the presence of an indicium with a left extending member creating an entry point into the array. Once an indicium in the first column is identified as having an extending member, each possible subsequent branch formed with linking adjacent indicia must then be investigated to determine if a payline can be made to extend across to an array position in the third column of the array. If the payline does extend across to the third column of the array, the indicium in that third column array position must have a right extending member to exit the array per the conditions imposed for payline construction.

If a payline is formed, the indicia designated by the payline are evaluated for winning indicia combinations in step 420. In one embodiment, winning game outcomes require specific combinations of indicia (i.e., indicium type combinations) which are typically listed in a pay table. In some embodiments, winning game outcomes may also require a specific sequence of indicia on the payline.

In still other embodiments, the indicia may have associated symbols. The symbols associated with the indicia designated by the payline determine a symbol combination which may be evaluated for winning symbol combinations in step 420. The award for such a winning indicia combination or, more specifically, a winning symbol combination may then be determined from a pay table in step 425.

Regardless of the formation of a payline in step 415, in this embodiment, the player is given the opportunity to respin the same array with the same indicia in step 430. Respinning changes the angular orientation of an indicium while maintaining its original array position. In some embodiments, the respin may be applied to all indicia in the array or, in other embodiments, to less than all the indicia. The player, the machine, or both the player and the machine may determine the specific indicia to respin. The respin process provides the potential for indicia to form new connections with other indicia and consequently, the potential for forming new paylines with winning game outcomes.

In this embodiment, the only difference in the array as a result of the respin (should the player opt to replay the same array) is that the angular orientation of each indicium in its original array position may be changed. Should the player decide not to play the same array again in step 430, the game is over in step 460.

In order to respin the array, in one embodiment, the player must place an additional wager in step 435. In this embodiment, the player is given the opportunity to weigh the probability of the array producing additional winning game outcomes from the respin before placing an additional wager. The appeal of the respin feature is that the player can selectively wager on those gaming arrays having the greatest potential for producing winning game outcomes. Consequently, the player may be limited to only one respin of the array to maintain the payback percentage of the game at a reasonable level.

In another embodiment, the player may be allowed to make additional wagers until a winning game outcome is achieved from the respin. In still another embodiment, the additional wager in step 435 may be waived if no paylines were formed in the original array.

In step 440, the angular orientation of each of the indicia in the array is randomly changed. The change in orientation of each of the indicia is randomly determined with a random number generator in conjunction with an angular change probability table.

Referring to FIG. 13, an exemplary embodiment of an angular change probability table 1300 is illustrated. In one embodiment, a random number 1310 is generated for each array position. This random number is used as an index into the table 1300 for the determination of the corresponding angular orientation change 1320 for the indicium. In this embodiment, the angular change probability table 1320 will randomly determine a change in angular orientation of the indicium of 0, 90, 180, or 270 degrees.

Referring back to FIG. 4, in step 445, the respun array is evaluated to identify new paylines formed by the angular reorientation of the indicia. If a payline is formed, the indicia on the payline are evaluated (including any symbols associated with the indicia) to determine whether those indicia form a winning game outcome in step 450. If winning indicia combinations are found, an award is provided for the winning game outcome in step 455 and the game is then over in step 460. If paylines are not formed in step 445, the game is over in step 460.

The embodiment described by the process flowchart of FIG. 4 is but one embodiment of the wagering game. Other embodiments include, for example, the same process described in FIG. 4 without the option of respinning the array as provided in step 430. Instead, the game is over after step 425 and a new game can then be commenced with an entirely new array of randomly selected indicia.

Figure 5A:
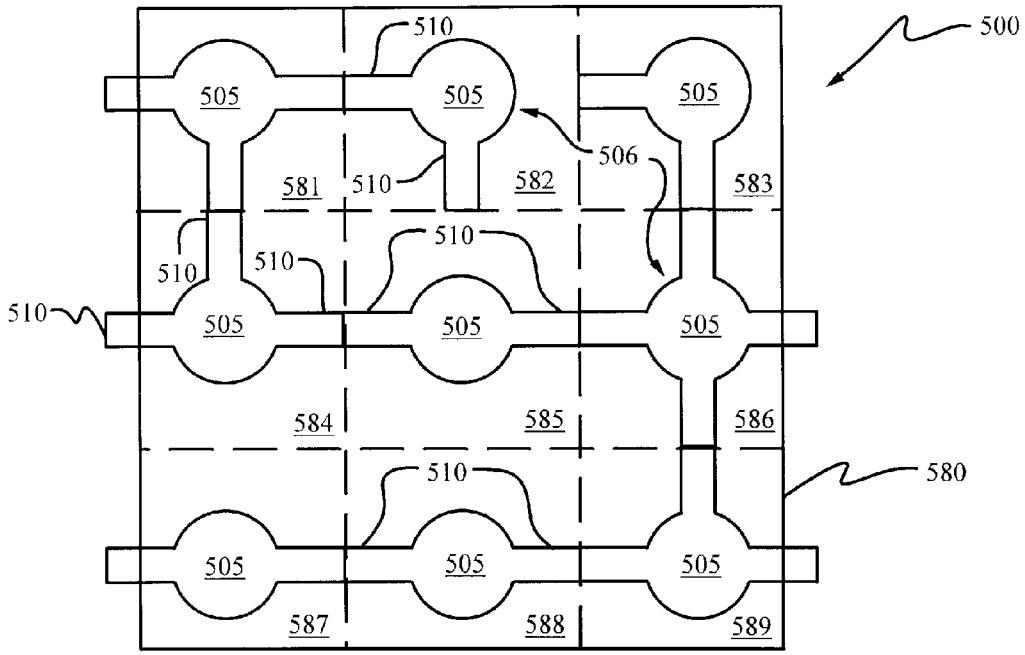
FIG. 5A is an exemplary game outcome of one embodiment of the wagering game.

Turning to FIG. 5A through FIG. 5F, an exemplary wagering game 500 progressively illustrates the paylines developed by the indicia. The wagering game 500 depicted generally follows the game play process depicted by flowchart 400 of FIG. 4. Referring to FIG. 5A, the wagering game 500 is depicted with a random selection of indicia 505 in a plurality of array positions 581 through 589 in an array 580. The indicia filling the array could be randomly selected from the indicia probability table of FIG. 12.

Each indicium in this embodiment can be grouped with other like indicia (i.e., indicium types) on the basis of indicium geometry characteristics, including: 1) the number of members 510 associated with an indicium, and 2) the relative angular position between the members of the indicium. The angular position of the indicium relative to its position in the array, however, is not related to indicium type in this embodiment. For example, the indicium in array position 585 has two members 510. Likewise the indicium in array position 582 also has two members. However, the indicium in array position 582 has a 90 degree angle between its two members 510, in contrast to the indicium in array position 585 which has a 180-degree angle between its two members. In this embodiment, these indicia are considered to be two different indicium types for purposes of receiving an award from the pay table. In other embodiments, only the number of members 510 determines like indicia (i.e., indicium type).

In the embodiment illustrated in FIG. 5A, the linking of indicia 505 requires a member 510 from each of two indicia to cooperatively indicate a link (i.e., directionally identify) by aligning the members between the indicia. For example, the indicia 505 in array positions 581 and 582 link (mutually identify) through the alignment of members 510 on each of the indicia (i.e., the indicia pair mutually, directionally identify).

In this embodiment, the indicium in each of the array positions may only link with adjacent indicia located in array positions orthogonal to the array position of a given indicium. For example, any indicium in array position 583 can only potentially link with indicia in array positions 582 and 586 (i.e., adjacent indicia). Another example is the indicium in array position 585 which can only potentially link with indicia in array positions 582, 584, 586, and 588 (adjacent indicia to the indicium in array position 585).

Paylines may be formed by the continuous linking of indicia (i.e., indicia linking together) horizontally across the array to form an entry and exit at the vertical boundaries of the array. Paylines extending from left to right in the array may travel vertically in a column with appropriately aligned members connecting indicia until further appropriately aligned members connecting indicia extending horizontally can continue travel of the payline. In this embodiment (illustrated in FIG. 5), as one of the payline construction rules, the payline may not backtrack (i.e., reverse direction) in either the rows or the columns of the array.

In addition, in this embodiment, paylines may also be formed by the continuous linking of indicia to achieve an entry and exit at the horizontal boundaries of the array. A plurality of indicia in the rows may be used to help make this continuous, vertical connection. Similar to the development of the horizontal paylines described above, paylines extending vertically may not backtrack in either the rows or the columns.

It is a further payline construction condition of this embodiment of the wagering game 500 that the payline must enter and exit the array 580. The entry and exit from the array 580 are indicated by the same member 510 associated with indicia 505 used to indicate a partial linking connection with adjacent indicia. In one embodiment, only a single member 510 from an indicium 505 is required to indicate entry or exit (i.e., extend) from the array 580.

For example, in array position 584, a member 510 associated with an indicium 505 extends to the left entering/exiting the array 580. In array position 586, a member 510 associated with an indicium 505 extends to the right entering/exiting the array 580. In this embodiment, the indicium in array position 584 and array position 586 are a first indicium and last indicium, marking the start and finish of the indicia developed payline. All of the linking indicia between the first indicium and the last indicium, in this embodiment, are considered part of the payline.

Depending upon the embodiment, either array position may be considered the first and last indicium of the payline. In other embodiments, however, winning indicia combinations may require a continuous sequence of predetermined indicia. These indicia and their sequence may require development from left to right, right to left, or from either left to right or right to left to obtain a winning game outcome depending on the embodiment.

The entry or exit indication does not require, in some embodiments, the extending member of the indicium to cross an array boundary. Instead, the indication for some embodiments only requires the member of the indicium to extend away from the array or in a specified direction. In one embodiment, exiting or entering the array may be equivalent with extending from the array. Extending from the array, in one embodiment, may be defined as any member of an indicium without an adjacent indicium.

Figure 5B:
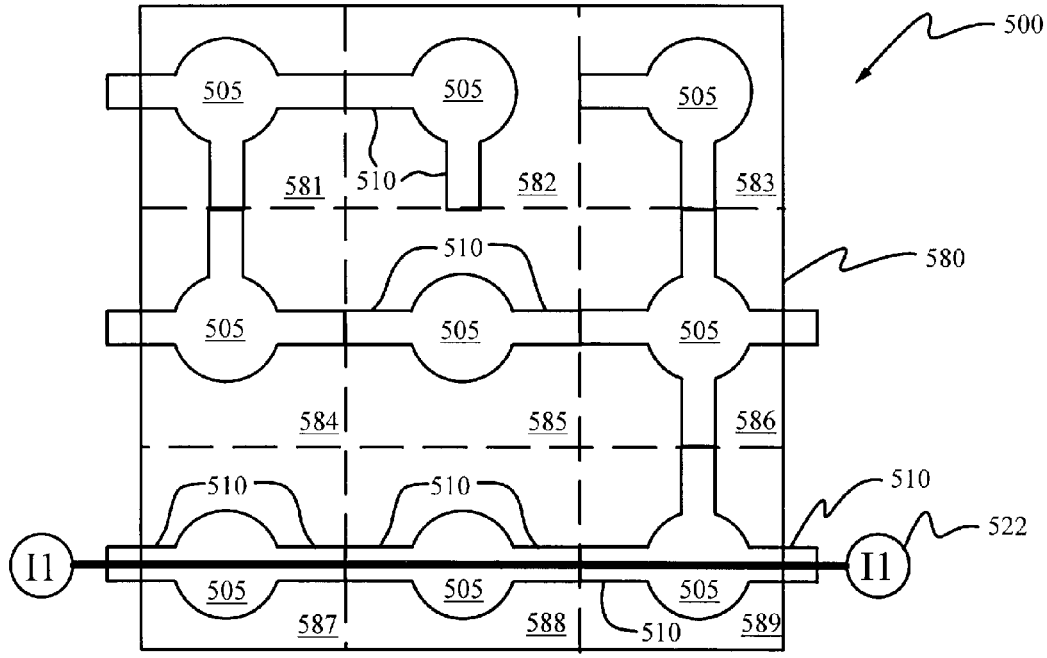
FIG. 5B is the exemplary game outcome of FIG. 5A illustrating a first indicia developed payline.

Turning to FIG. 5B and applying the above described payline construction conditions, the wagering game 500 has identified a first indicia developed payline 522 created by the indicia 505 in array positions 587, 588, and 589 (linking indicia). In accordance with the payline construction conditions, indicium 505 in array position 587 has a member 510 entering the array 580. Similarly, the indicia 505 in array position 589 has a member 510 exiting the array 580. Furthermore, the members 510 link together the indicia 505 in array positions 587, 588, and 589 to form a subset of indicia. Consequently, the payline 522 in FIG. 5B may receive an award if the indicia in array positions 587, 588, and 589 designated by the payline form a winning indicia combination.

Figure 5C:
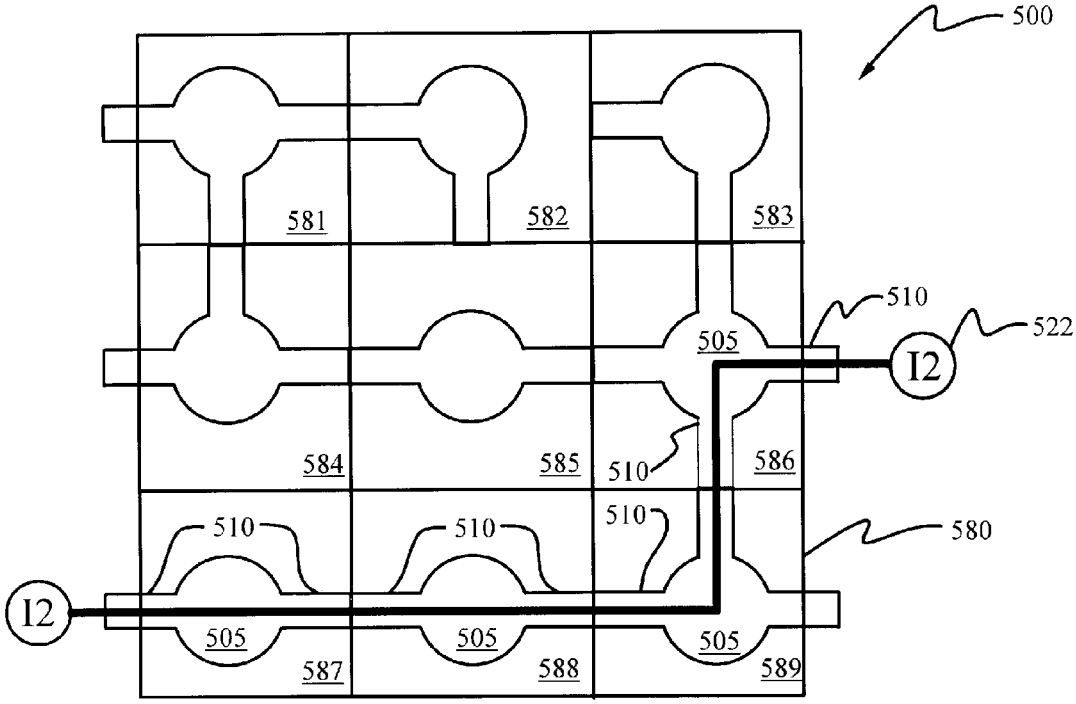
FIG. 5C is the exemplary game outcome of FIG. 5A illustrating a second indicia developed payline.

Turning to FIG. 5C, another payline 522 has been identified by the wagering game 500 developed by indicia 505 in array positions 587, 588, 589, and 586 (linking indicia). Again, each of the indicia 505 in array positions 587 and 586 have members 510 indicating an entry and exit point for the payline 522 from the array 580. Furthermore, the members 510 link together the indicia 505 in array positions 587, 588, 589, and 586 to form a subset of indicia. Consequently the payline 522 in FIG. 5C may receive an award if the indicia in array positions 587, 588, 589, and 586 designated by the payline forms a winning indicia combination.

It should be noted that FIG. 5B and FIG. 5C each have similar paylines. Both use the indicia in array positions 587, 588, and 589. However, FIG. 5C extends the payline of FIG. 5C with the indicium in array position 586. Consequently, the wagering game may, in one embodiment, identify all possible paylines satisfying the required payline construction conditions, regardless of other indicia linking with the subset of indicia identified. In this embodiment, these other indicia, linking with identified subsets of indicia, are ignored for the purposes of determining an award for the identified subset of indicia.

For example, in FIG. 5B, the indicium in array position 586, although it could be linked to the other indicia in array positions 587, 588, and 589, is ignored for the purposes of determining a winning game outcome for payline I1. Payline I2, depicted in FIG. 5C, is also identified for a possible winning game outcome in this embodiment. Thus, in one embodiment, the wagering game maximizes the identification of paylines in the array which satisfy payline construction conditions without regard to unnecessary linking indicia in the identified subset of indicia.

In other embodiments, only one winning game outcome may be identified based on the subset of indicia formed from all the indicia which can possibly be linked together. In this embodiment, FIG. 5C showing payline I2 would produce a winning game outcome, and payline I1 shown on FIG. 5B would not receive a winning game outcome.

In still other embodiments, an award is only paid for the subset of indicia identified providing the largest award amongst a plurality of identified indicia subsets, all formed from the same group of linking indicia. Consequently, again referring to FIG. 5B and FIG. 5C, the payline with the greater award is paid; or, if the two paylines have the same award, only a single award is made.

Figure 5D:
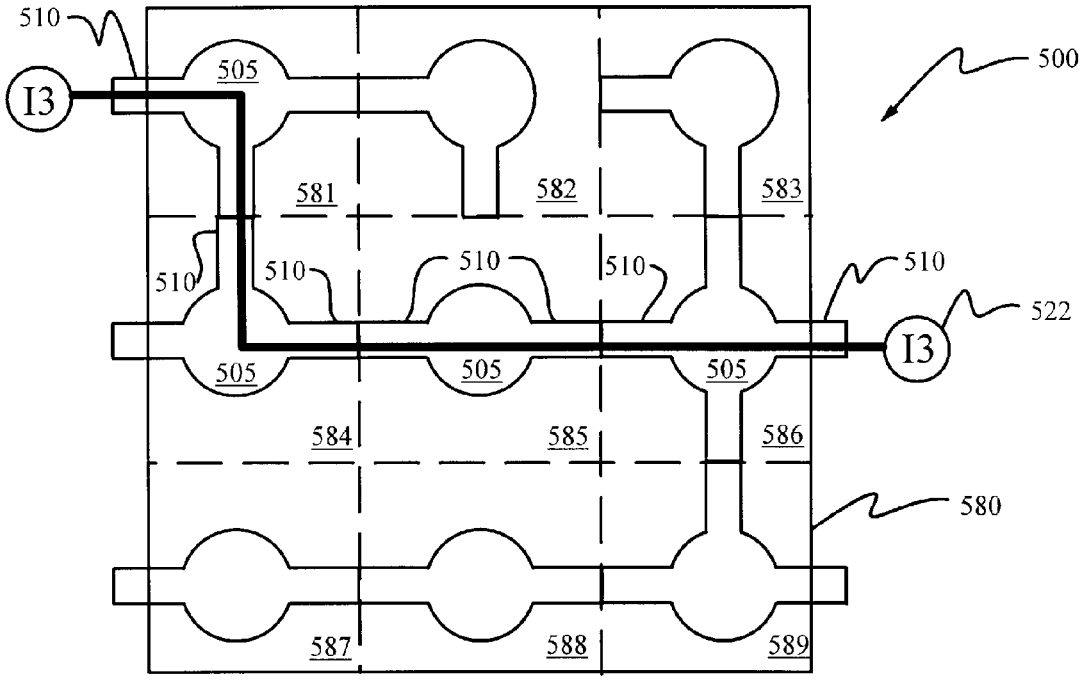
FIG. 5D is the exemplary game outcome of FIG. 5A illustrating a third indicia developed payline.

Turning to FIG. 5D, another payline 522 has been identified by the wagering game 500 created by indicia 505 in array positions 581, 584, 585, and 586 (linking indicia). Indicia 505 in array positions 581 and 586 have members aligned to provide an entry and exit point for the payline 522 from the array 580. Furthermore, the members 510 link together the indicia 505 in array positions 581, 584, 585, and 586 to form a subset of indicia. Consequently the payline 522 in FIG. 5D may receive an award if the indicia in array positions 581, 584, 585, and 586 designated by the payline forms a winning indicia combination.

Figure 5E:
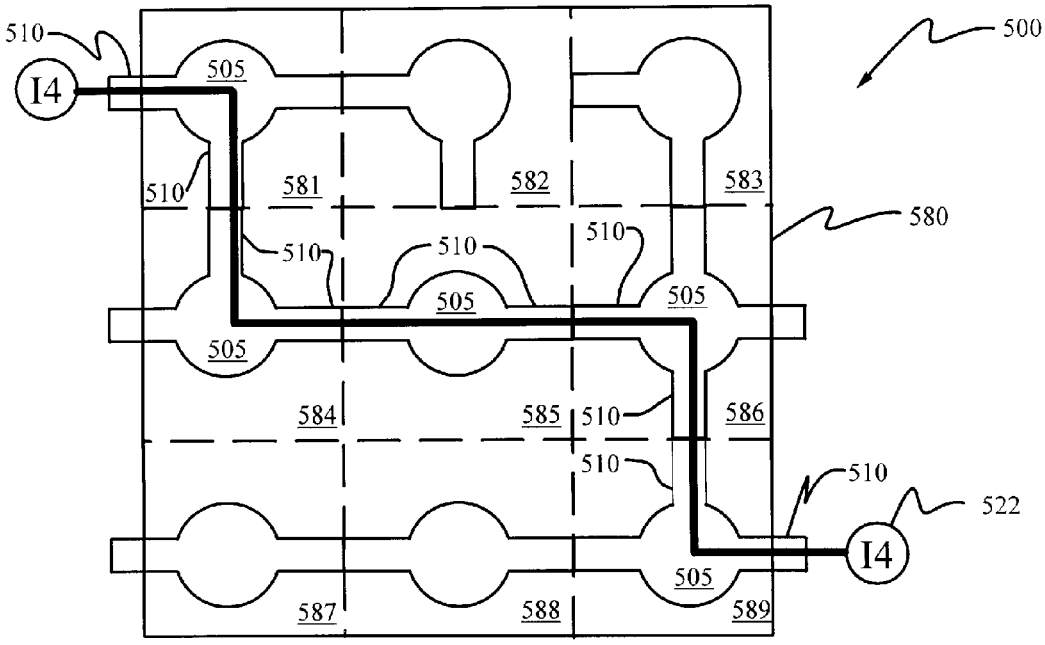
FIG. 5E is the exemplary game outcome of FIG. 5A illustrating a fourth indicia developed payline.

Turning to FIG. 5E, another payline 522 has been identified by the wagering game 500 developed by indicia 505 in array positions 581, 584, 585, 586, and 589 (linking indicia). Again, indicia 505 in array positions 581 and 589 have members 510 aligned to provide an entry and exit point from the array 580. Furthermore, the members 510 link together the indicia 505 in array positions 581, 584, 585, 586 and 589 to form a subset of indicia. Consequently, the payline 522 in FIG. 5E may receive an award if the indicia in array positions 581, 584, 585, 586, and 589 designated by the payline forms a winning indicia combination.

Once the paylines have been identified (as shown in FIG. 5B-FIG. 5E), each individual payline can be assessed for a winning game outcome. The wagering game 500 illustrated in FIG. 5 has four different indicia developed paylines 522. Each of these indicia developed paylines 522 is potentially eligible for an award depending on the indicia 505 designated by the payline. Indicia combinations forming a winning game outcome and the award associated with that winning game outcome is generally contained in a pay table for the wagering game.

Figure 5F:
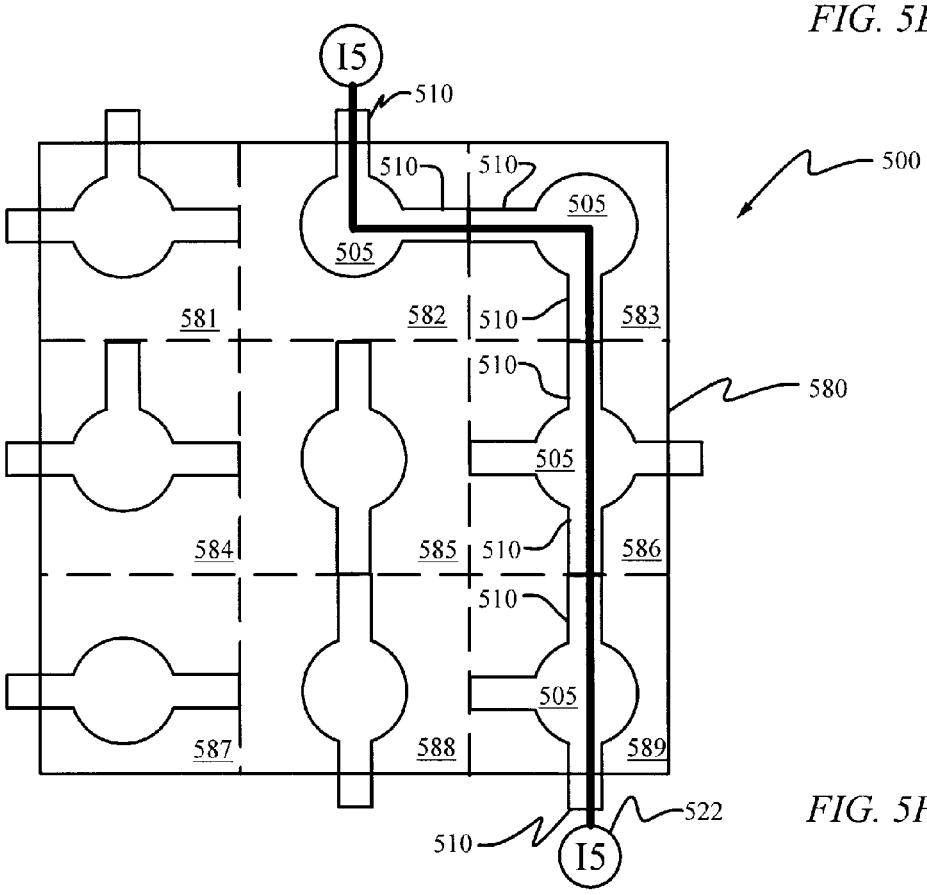
FIG. 5F is an exemplary game outcome received from the random angular reorientation of the indicia in the array depicted in FIG. 5A.
Figure 6:
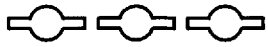
FIG. 6 is an exemplary pay table for the exemplary wagering game embodiment of FIG. 5.
Figure 6:
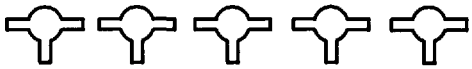
Figure 6:
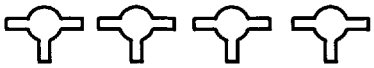
Figure 6:
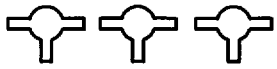
Figure 6:
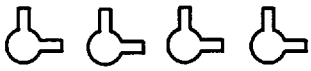
Figure 6:
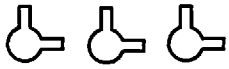
Figure 6:
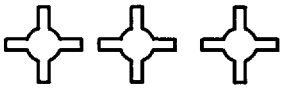

Referring to FIG. 6, an exemplary pay table 600 for the wagering game 500 embodiment illustrated in FIG. 5 is provided. The pay table 600 of FIG. 6 makes an award 620 based on the winning indicia combination 610 formed by the indicia on the payline, irrespective of the position of the indicia on the payline in this embodiment. The indicium type (as determined by the number of members on each indicium and the relative position of the members) of each of the indicia on the payline determines whether the payline has a winning indicia combination 610 and a winning game outcome. In addition, the degree of difficulty in forming the payline is, in this embodiment, taken into account in the determination of the award 620 listed in the pay table 600.

For the wagering game 500 embodiment exemplified by FIG. 5, one of the payline construction conditions, in this embodiment, is that the payline may not backtrack in any direction (i.e., reversing direction is not permitted). By inspection, the longest possible payline potentially available in this wagering game 500 is a link of five indicia exemplified by the illustration of FIG. 5E. The shortest payline is a link of three indicia exemplified by the illustration of FIG. 5B. Consequently, a payline with a winning game outcome could potentially include three, four, or five identical indicia.

Pay table 600 lists winning indicia combinations having up to five identical indicia. A minimum of three identical indicia are required to achieve a winning game outcome. These identical indicia may occur on the payline in any order. It should be noted, in this embodiment, the angular orientation of the indicia is irrelevant to the determination of a winning game outcome and to any possible award. The orientation of the indicia is only relevant to the creation of paylines in this embodiment.

This type of winning game outcome is similar to a "scatter" pay of a traditional slot type game. In another embodiment, if desired, three consecutively positioned indicia may pay more then three indicia that are not consecutively positioned from left to right on the payline or right to left. Furthermore, in still another embodiment, a winning game outcome having indicia with the same angular orientation may provide a larger award than the same number of identical indicia having different angular orientations.

Applying this pay table 600 to the exemplary wagering game 500 embodiment illustrated in FIG. 5, it is apparent that the only winning game outcome occurs on the payline 522 shown in FIG. 5E. The remaining paylines depicted in FIG. 5 do not have the three or more identical indicia required for a winning game outcome.

The indicia developed payline 522 of FIG. 5E designates five array positions, with three array positions having identical three-member indicia occurring in array positions 581, 584, and 589. Although these indicia do not occur consecutively across the payline, they are eligible for an award. Referring back to FIG. 6, as can be seen from pay table 600, an award 620 of three credits is paid for this winning indicia combination 610. Consequently, the player has won three credits for this array.

Returning to the exemplary wagering game 500 embodiment depicted in FIG. 5 (and following the flowchart 400 embodiment illustrated in FIG. 4), the player now has the opportunity to place an additional wager to respin (randomly change the angular orientation) each indicium in its original array position. In some embodiments, the original angular orientation of an indicium may be randomly selected again, maintaining the same relative angular orientation in the array.

With the respin game play mechanic, a player is given the opportunity to strategically assess the probability of obtaining winning game outcomes from the random angular reorientation of the indicia. To assist the player in assessing the probability of success with a respin, the indicia may be colorized, in one embodiment, to help the player quickly assess the strength of the indicia in the array. For example, indicia having four members may be colored green, indicia having three members may be colored blue, indicia having two members may be colored yellow, and indicia having no members may be colored red (e.g., depicted as a circle with which no indicia can link with). Respinning an array having substantially all green and blue indicia would have a higher probability of producing a winning game outcome than an array substantially filled with red and yellow indicia.

In another embodiment, in lieu of respinning the indicia, the original array may be reformed by placing the original indicia into random array positions with the same angular orientation. Furthermore, the reformed array may also be respun, in one embodiment.

Referring to FIG. 5F, the player has made the additional wager and the angular orientation of the indicia in the array has been randomized (i.e., respun). As a result, a new indicia developed payline 522 has been created from the top to the bottom of the array 580 in array positions 582, 583, 586, and 589. This payline, however, does not contain the minimum requirement of three identical indicia, making it ineligible for an award per the pay table 600 illustrated in FIG. 6.

Although the embodiment illustrated in FIG. 5 has paylines that are similar to left to right and top to bottom paylines found in traditional slot type gaming machines, other embodiments are also available employing less traditional payline geometry. For example, in one embodiment, any path created by connecting indicia that enters and exits the array may be considered a payline and potentially eligible for an award.

Figure 7:
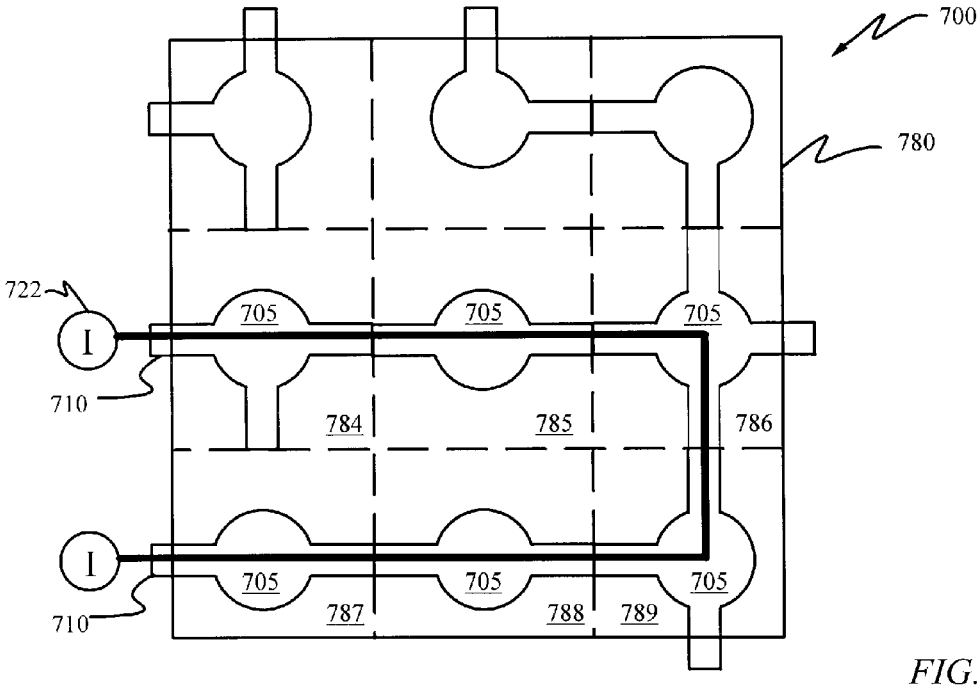
FIG. 7 is an exemplary game outcome illustrating an indicia developed payline entering and exiting the same side of the array.

For example, in FIG. 7, one embodiment of the wagering game 700 is depicted with the randomly selected indicia forming an array 780. The indicia developed payline 722 created by indicia linking together in array positions 784, 785, 786, 789, 788, and 787 enters and exits the same side of the array 780. The indicium in array position 784 includes a member 710 for entering/exiting the array 780, and the indicium in array position in 787 has a member 710 for exiting/entering the array.

Figure 8:
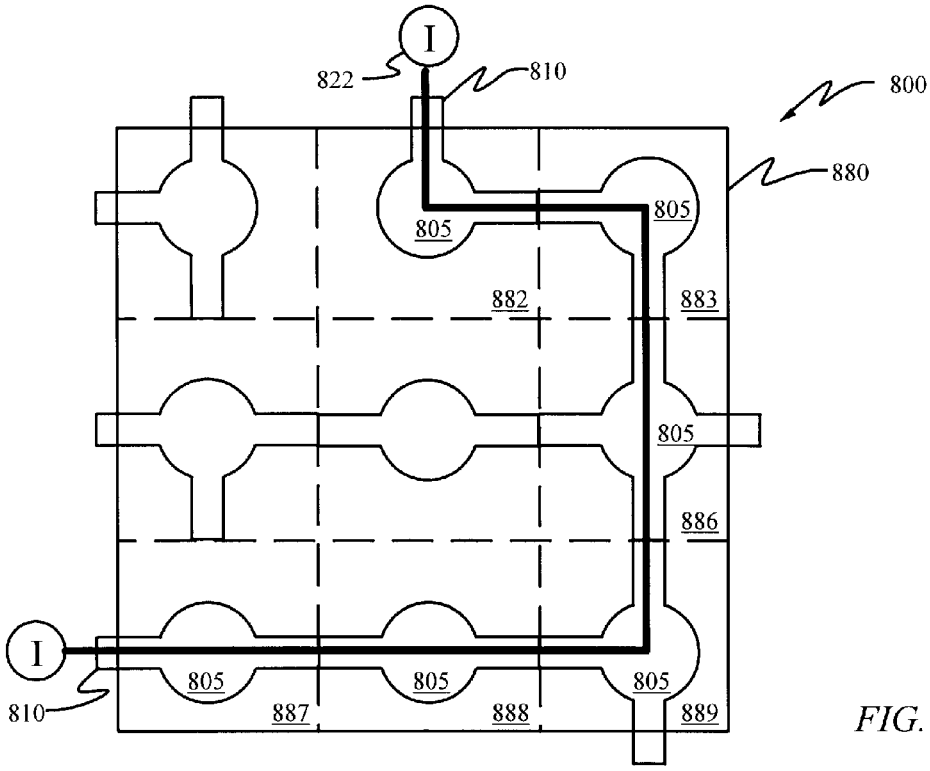
FIG. 8 is an exemplary game outcome illustrating an indicia developed payline entering the side and exiting the top of the array.

Referring to FIG. 8, another non-traditional payline is illustrated in a wagering game 800 having randomly selected indicia forming an array 880. In the embodiment illustrated in FIG. 8, the wagering game 800 has a payline 822 entering the left side of the array 880 and exits at the top of the array 880 through the linked indicia in array positions 887, 888, 889, 886, 883, and 882. The indicium in array position 887 has a member 810 for entering/exiting the array 880, and the indicium in array position 882 has a member 810 for exiting/entering the array.

In the embodiments discussed above, the paylines have an indicium at the start and at the end of the payline having a member entering and exiting the array respectively. In other embodiments, there is no requirement for the payline to have indicia with members entering and exiting the array; the indicia in the subset of indicia must only link together.

Figure 9A:
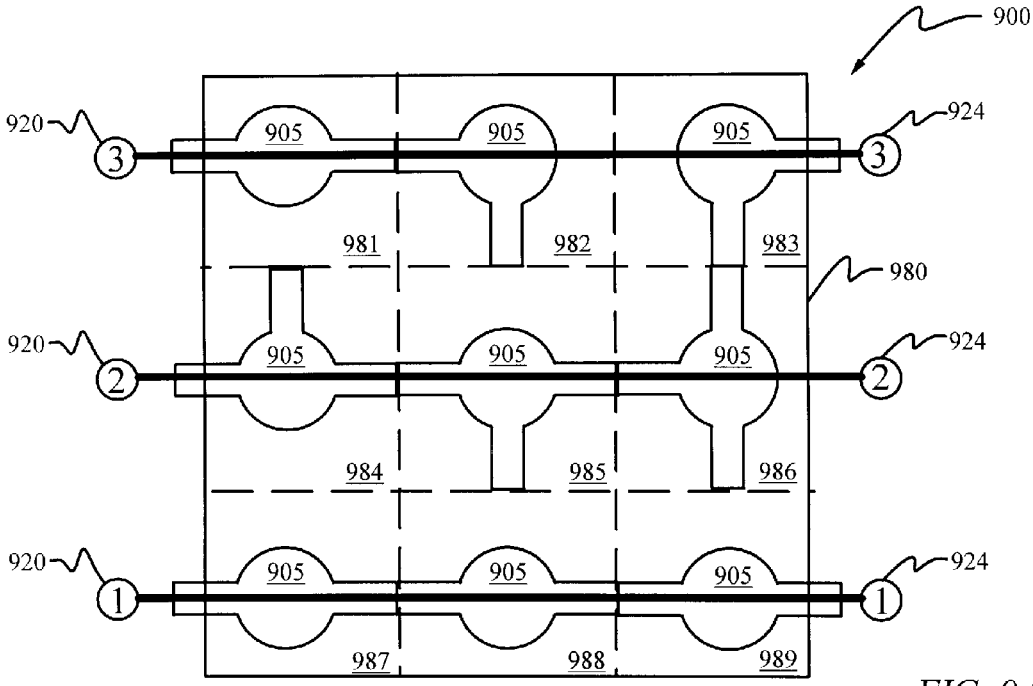
FIG. 9A is an exemplary game outcome for one embodiment of the wagering game having both preset and indicia developed paylines.

Referring to FIG. 9, another embodiment of the wagering game 900 is depicted having an array 980 filled with randomly selected indicia having preset paylines 924. These preset paylines 924 designating predetermined array positions are similar to those on traditional slot type wagering games. The player may wager on the three traditional horizontal preset paylines 924: 1) the first row (array positions 981, 982, and 983); 2) the second row (array positions 984, 985, and 986); and 3) the third row (array positions 987, 988, and 989). In this embodiment, the player makes a wager for each of these three preset paylines 924 and may receive any indicia developed paylines as a bonus for playing the wagering game 900. For simplicity and ease of illustration, the indicia developed payline construction conditions are the same in this embodiment as for the exemplary embodiment of FIG. 5.

Figure 9B:
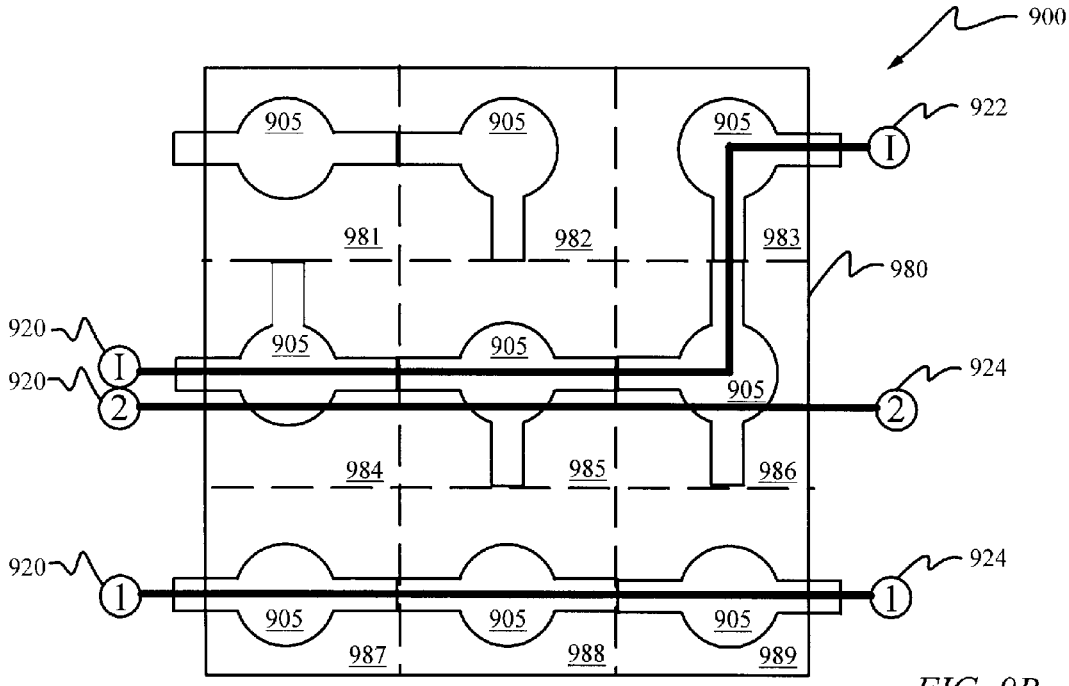
FIG. 9B is the exemplary game outcome of FIG. 9A illustrating a winning indicia developed payline and two winning preset paylines.

Referring to FIG. 9B, the highlighted paylines designate the winning game outcomes. In this exemplary game outcome, the player has received winning game outcomes on two types of paylines 920: 1) the preset paylines 924 through array positions 984, 985, 986 and through array positions 987, 988 and 989; and 2) the two indicia developed paylines 922 formed by indicia in array positions 984, 985, 986, and 983 and array positions 987, 988 and 989. However, in this embodiment, any paylines designating the same array positions are only paid the larger of the two possible awards.

Referring to FIG. 10, another embodiment of an exemplary pay table 1000 is depicted for the wagering game 900 embodiment of FIG. 9. In this exemplary pay table 1000, any payline with three or more indicia of the same indicium type is a winning game outcome as shown by the winning indicia combinations 1010. The indicia developed payline awards 1020 are listed for each of the winning indicia combinations 1010 (the angular orientation is irrelevant to the award). The exemplary pay table 1000 of FIG. 10 also includes preset payline awards 1030 which require three of the same indicium type to receive an award. The preset payline awards 1030 are available in two different types for winning indicia combinations: 1) the same angular orientation award 1032 and 2) different angular orientation award 1034.

Referring back to FIG. 9B, the preset payline 924 designating array positions 984, 985, and 986 includes three, three-member indicia, with different angular orientations. Therefore, referring to FIG. 10, according to the pay table 1000, the winning indicia combination 1010 of three, three-member indicia provides a preset payline award 1030 for indicia with different angular orientations 1034 of two credits.

Referring back to FIG. 9B, the preset payline 924 designating array positions 987, 988, and 989 includes three indicia of the same type in the same angular orientation. Again, referring to FIG. 10, according to the pay table 1000, the winning indicia combination 1010 of three, two-member indicia provides a preset payline award 1030. In this example, because the indicia have the same orientation, the winning indicia combination would receive the same angular orientation award 1032 of three credits. However, as noted above, the three, two-member indicia form an indicia developed payline. In this case the three, two-member indicia forming the payline are eligible to receive an award of five credits. Consequently, the player receives only the larger of the two awards (i.e., five credits) for this payline.

Referring back to FIG. 9B, the indicia developed payline 922 designating array positions 984, 985, 986, and 983 has three indicia of the same type. Referring to FIG. 10, according to the pay table 1000, the winning indicia combination 1010 of three, three-member indicia, provides an indicia developed payline award 1020 of three credits.

Although all the exemplary embodiments described above are indicia with up to four members, other embodiments are possible with indicia having any number of members. For example, in one embodiment, indicia with up to eight indicating members may be positioned at 0, 45, 90, 135, 180, 225, 270, and 315 degrees. This allows indicia developed paylines to be formed not only in orthogonal (i.e., horizontal and/or vertical directions), but also along diagonal lines in the array. In another embodiment, the members of the indicia may be placed at non-uniform intervals.

Diagonal paylines may also be developed by allowing the orthogonal indicia (i.e., indicia with up to four members positioned at 0, 90, 180, and 270 degrees) to stop with members at a 45, 135, 225, or a 315 degree angle—rather than limited to 0, 90, 270, and 360 degree angles (which establish orthogonal paylines as described in the exemplary embodiment of FIG. 5). Similarly, the up to eight-member indicia described above may also be stopped and positioned at multiples of 45 degrees.

Figure 14:
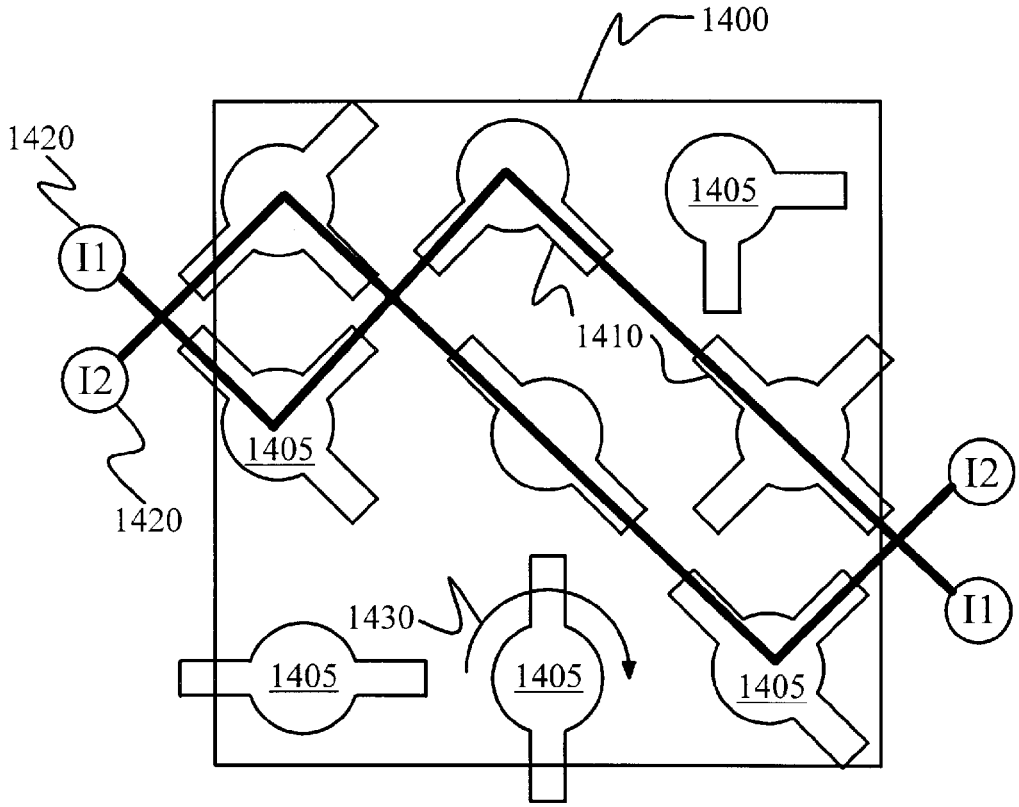
FIG. 14 is an exemplary game outcome for an embodiment of the wagering game having indicia producing diagonally developed paylines.

For example, referring to FIG. 14, an exemplary embodiment of a wagering game outcome 1400 is illustrated with indicia 1405 allowed to randomly stop their angular rotation (as indicated by arrow 1430) with members 1410 at a 45, 90, 135, 180, 225, 270, 315, and 360 degree angle. Diagonal paylines 1420 are formed through indicia 1405 with members 1410 in direct alignment.

In still another embodiment, the indicia may have associated symbols. For example, an indicium may have both a plurality of members and an associated symbol (e.g., traditional fruit symbols such as cherries, watermelons, grapes, etc. depicted on the indicium). In this embodiment, the members of the indicia form the payline while the symbols on the indicia determine a winning game outcome. Consequently, the indicia and the symbols are distinguishable by their separate and distinct functions. Furthermore, in some embodiments, the symbol may be associated with any indicium type, further distinguishing the symbol from the indicium. In one embodiment, each indicium and associated symbol is selected in separate steps from an indicia probability table and a symbol probability table respectively with the aid of a random number generator. In another embodiment, the indicia and their associated symbols are randomly selected and assigned to the array using a random number generator and a single probability table.

For example, referring to FIG. 15, an exemplary probability table 1500 for randomly selecting both the indicia 1520 and the symbols 1530 associated with the indicia is illustrated. In this exemplary multi-characteristic probability table 1500, the table includes all the indicia 1520 in all their possible orientations and each of the cards in a standard card deck as the associated symbols 1530. For brevity, FIG. 15 is only a partial probability table, containing only the different possible indicia combinations for the Ace of Clubs and King of Clubs. The remaining fifty cards, containing the remaining rank and suit combinations for all the ten possible different indicium types and orientations, are not shown. The additional entries required to complete the table is simply a progression of the random numbers 1510 repeating the indicia 1520 listed in the pay table for each card's rank 1540 and suit 1550.

As discussed previously, a random number generator determines a random number which is used as an index into the indicia and symbol probability table 1500 of FIG. 15. The indicium and symbol corresponding to a selected random number is used to fill the array position. For example, in this embodiment, if the number 3 is randomly generated, a two-member indicium having the Ace of Clubs symbol is used to fill the array position (with the angular orientation depicted in the probability table for the indicium).

Alternatively, in lieu of a single, combined indicia and symbol probability table, in another embodiment, two separate probability tables could be used to randomly fill the array. In this embodiment, an indicia probability table for selecting the indicium and its angular position in each array position (similar to FIG. 12) could be used in conjunction with a symbol probability table (containing each of the selectable cards in the card deck) to associate a symbol with each selected indicium. In this embodiment, two separate random numbers are generated from two different random number generators, one for the indicia probability table and the other for the symbol probability table. Once randomly selected, the indicium and the associated symbol can be assigned to the array.

Figure 11A:
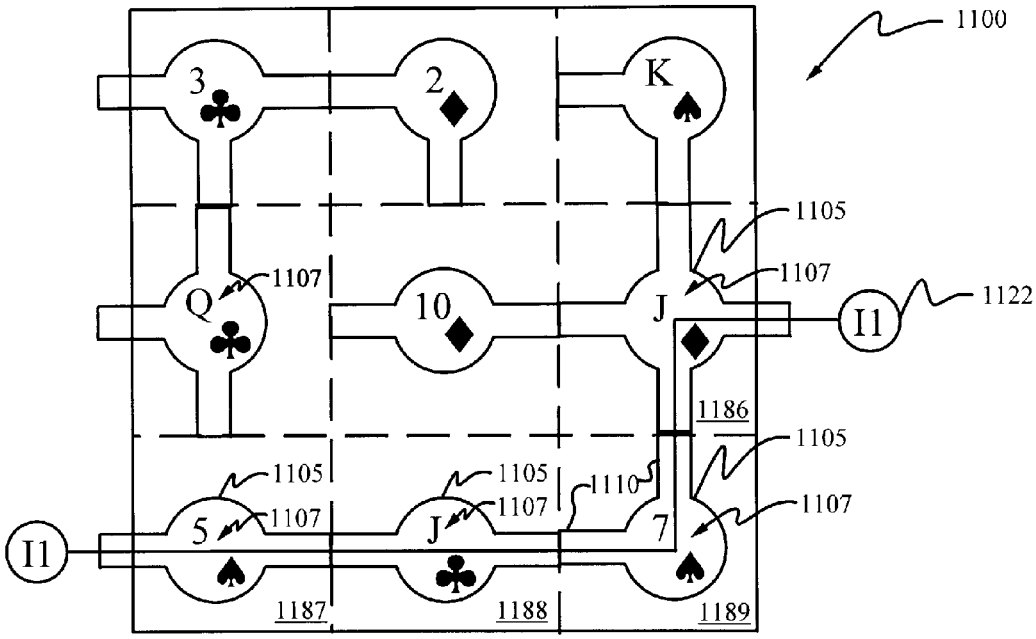
FIG. 11A is an exemplary game outcome for an embodiment of the wagering game having indicia with associated symbols.

Referring to FIG. 11A, an exemplary array is illustrated formed from dual characteristic indicia using a probability table similar to FIG. 15. The exemplary wagering game 1100 has indicia 1105 with associated symbols 1107. In this embodiment, the symbols are dual characteristic symbols having both a suit and a rank. The indicia 1105 designated by the indicia developed payline 1122 determine the card hand which, in this embodiment, is based on the associated symbols 1107 displayed on each of the designated indicia.

The associated symbol 1107 (or symbols) on each indicium 1105 are distinguishable from the indicium. For example, in array position 1189, the indicium 1105 has two members 1110 and an associated symbol 1107 (the Seven of Spades). Consequently, in this embodiment, the indicia are a combination of a card symbol (e.g., Seven of Spades) to determine a winning game outcome and a number of members 1110 for forming paylines.

FIG. 11A illustrates an exemplary game outcome with a winning indicia developed payline 1122. In this wagering game embodiment, the same payline conditions used for the wagering game embodiment of FIG. 5 are applicable to this embodiment. Consequently, array positions 1187, 1188, 1189, and 1186 form a payline 1122. In this wagering game embodiment, the objective of the game is to form a winning poker hand.

In this wagering game embodiment, similar to the wagering game embodiment payline construction rules illustrated in FIG. 5, the winning game outcomes may comprise between three and five indicia. Consequently, pay tables may be available for 3, 4, and 5-card poker games. In this exemplary outcome, the player has a Pair of Jacks. The award for such a game outcome may be indexed to a pay table for a four-card poker game (not shown)—based on the four indicia comprising the payline 1122.

Figure 11B:
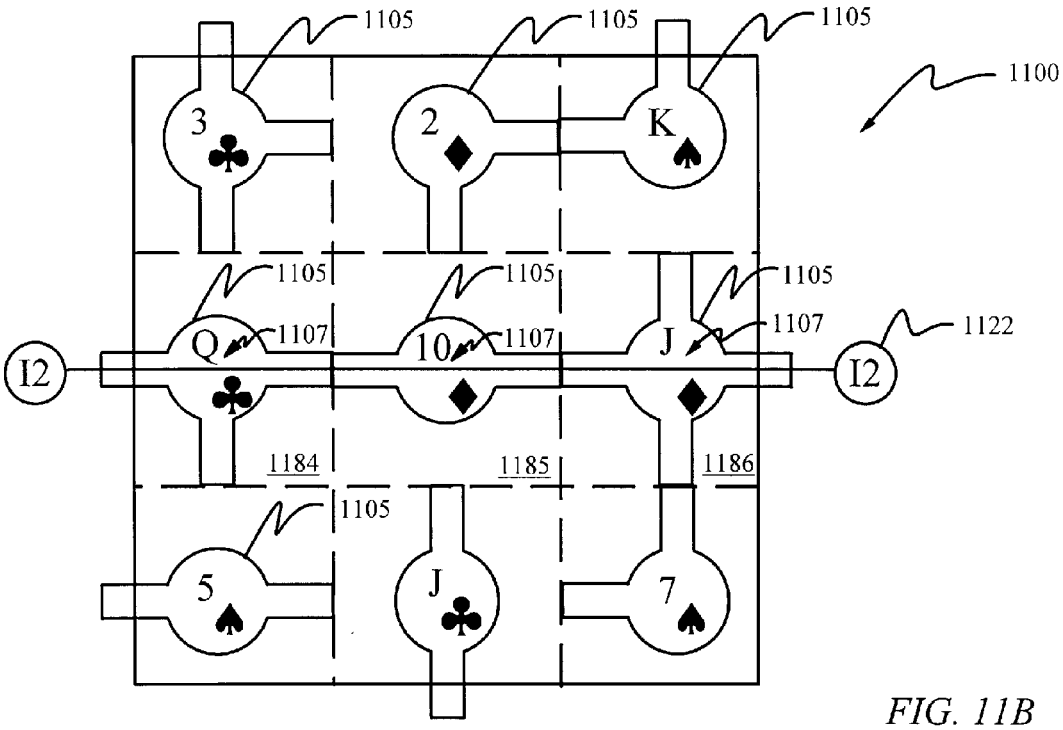
FIG. 11B is an exemplary game outcome received from the random angular reorientation of the indicia in the array depicted in FIG. 11A.

Referring to FIG. 11B, the indicia have been respun while the symbols associated with the indicia remain stationary (for ease of player viewing). As a result of the respin, new paylines have been created. As can be seen from FIG. 11B, a new indicia developed payline 1122 in array positions 1184, 1185, 1186 has been created. A new winning game outcome has been created on this payline comprising the symbols: Queen of Clubs, Ten of Diamonds, and Jack of Diamonds. These symbols create a straight in a typical three-card poker game. Similar to the discussion above, this three-indicium payline could be associated with a three-card pay table. Such an exemplary pay table is illustrated in FIG. 16.

In another embodiment, instead of only referencing the symbol combination derived from the indicia subset to determine an award from the pay table, both the symbol combination and the indicium types comprising the indicia subset are used to determine an award. Similar to the embodiment described above, the symbol combination is the first threshold for determining the award for a winning game outcome on an identified payline. The base award for the winning symbol combination can be determined from a pay table (e.g., see FIG. 16). Next, the indicium types forming the indicia subset identifying the winning symbol combination are used to determine an indicia factor for adjusting the base award. This indicia factor, in one embodiment, takes into account the level of difficulty to obtain a payline with various indicium types.

For example, obtaining a payline with three and four-member indicia may be easier than obtaining a payline with three two-member indicia (depending on the payline construction rules and relative population of the indicia set of various indicium types). Consequently, a payline designating three, two-member indicia having three Aces will pay a higher award in this embodiment than if the symbols were associated with three and four-member indicia.

In one embodiment, the indicia factor is incorporated into a single pay table that provides the award for every possible winning symbol combination and indicium type combination. Alternatively, an indicia factor may be provided for each of the possible indicium type combinations. This indicia factor may be applied to a winning symbol combination award to determine the award for a particular winning game outcome.

For example, in one embodiment, two tables are used to determine the award for a winning symbol combination: a pay table for each of the possible winning symbol combinations and an indicia factor table for each of the possible indicium type combinations. The pay table determines the symbol combination award (i.e., base award) for a particular winning symbol combination (e.g., see the exemplary pay table illustrated in FIG. 16). The indicia factor table determines the factor corresponding to a particular indicium type combination.

Figure 17:
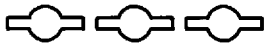
FIG. 17 is an exemplary indicia factor table for various indicium type combinations for a three-card Poker game.
Figure 17:
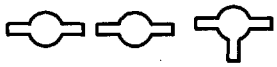
Figure 17:
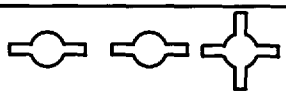
Figure 17:
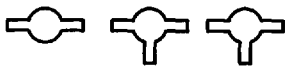
Figure 17:
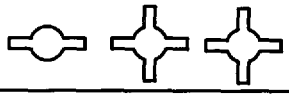
Figure 17:
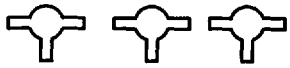
Figure 17:
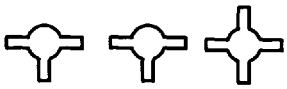
Figure 17:
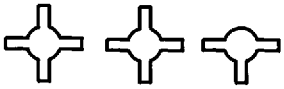
Figure 17:
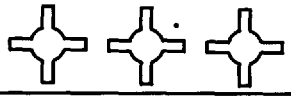

Referring to FIG. 17, an exemplary indicia factor table 1700 used in one embodiment to determine factors 1720 corresponding to indicium type combinations 1710 is illustrated. In this exemplary factor table 1700, each of the possible indicium type combinations 1710 are illustrated with a corresponding factor 1720. With this table, the factor corresponding to the indicium type combination designated by a payline can be determined. This factor is used in conjunction with the symbol combination award (see FIG. 16) to determine the award for the winning symbol combination in this embodiment. As a result, in this embodiment, the award for a winning game outcome is a function of both the symbol combination and the indicium types forming the indicia subset.

For example, in one embodiment, the indicia factor may be a multiplier which is used to multiply the symbol combination award. In this embodiment, the multiplier (i.e., factor) need not be determined to exactly correlate to the probability of receiving a particular indicium type combination. The factors from the factor table may be rounded off to whole numbers and presented to the player as multipliers. The desired overall payback percentage can then be achieved with the appropriate modifications to the symbol combination awards and the distribution of the multipliers in the factor table.

Furthermore, multipliers (factors) may be available for only a select few indicia combinations. For example, in one embodiment, multipliers may be available only for indicium type combinations having the same indicia. For example, in this embodiment, three, two-member indicia; three, three-member indicia; or three, four-member indicia designated by a payline in the FIG. 5 embodiment would receive a multiplier. Similarly, for a four indicium and a five indicium payline, a factor would only be applied to the symbol combination award for a payline with identical indicia. This multiplier may be the same for any payline with identical indicia or may be adjusted for the probability of forming a payline with specific, identical indicium types.

In other embodiments, other mathematical functions may be applied, using the factors and the symbol combination awards in combination to determine the award for a winning game outcome. For example, the factor determined from the factor table may also be used, in one embodiment, to determine a bonus in excess of the symbol combination award. In this embodiment, the award for a winning game outcome is the symbol combination award and the bonus award. The bonus award, in this embodiment, is determined as a function of the indicia factor and the symbol combination award.

Figure 18:
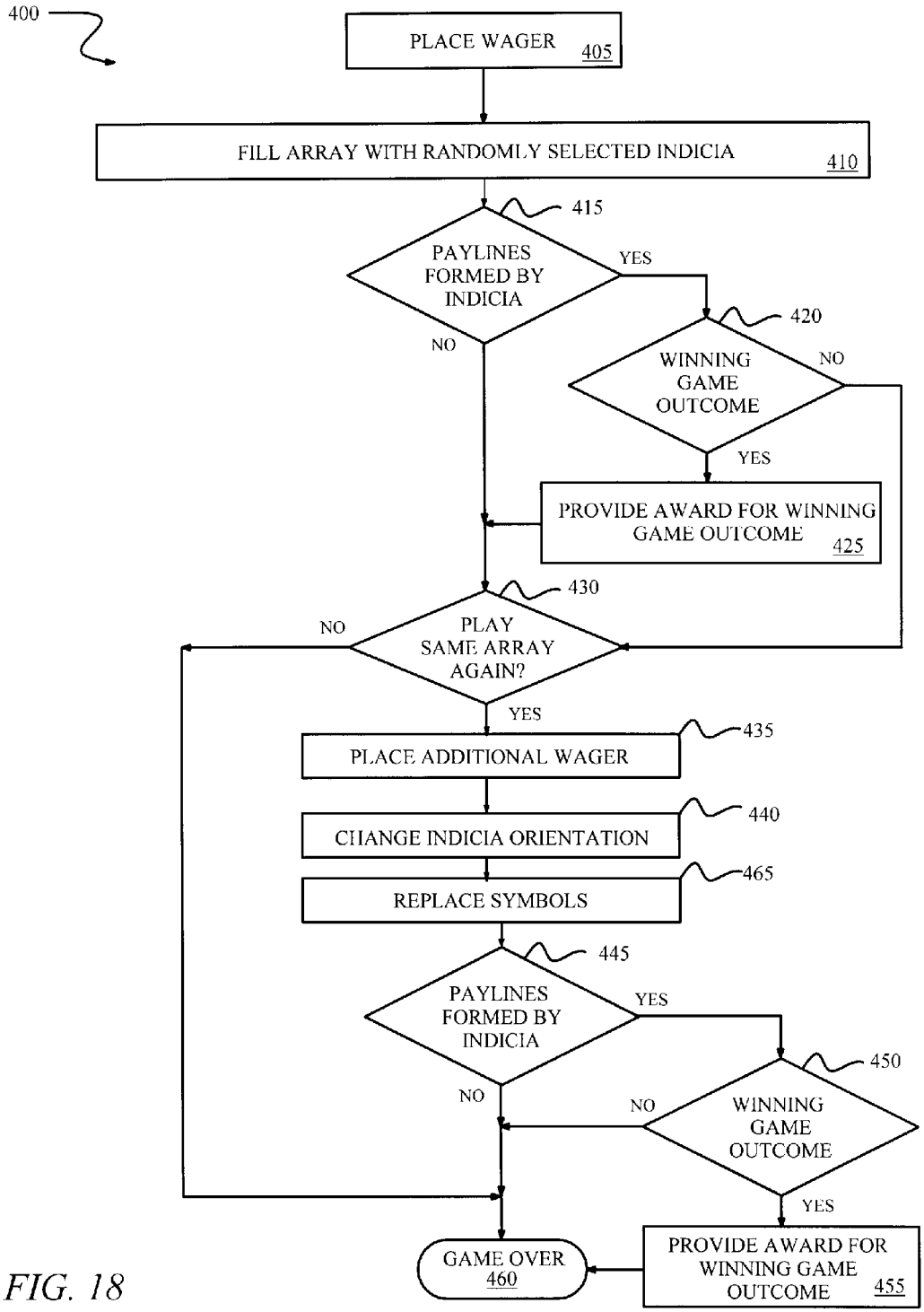
FIG. 18 is an exemplary process flowchart illustrating the game play of one embodiment of the wagering game with a replay feature changing both the indicia orientation and associated symbols.

Turning to FIG. 18, a flow chart for another embodiment of the wagering game is illustrated. In this embodiment, after the initial game outcome, the player has the option to replay the game array; which includes rotating the indicia into new rotational positions and changing the symbols associated with the rotated indicia.

The flowchart of FIG. 18 follows substantially the same process as the wagering game embodiment depicted in the flowchart of FIG. 4. Similarly to the wagering process in FIG. 4, the player is given the option in step 430 to replay the game array. In this embodiment, replaying the array requires an additional wager in step 435. Once the additional wager has been paid, each of the indicia are rotated in randomly selected increments in step 435. In addition, a new symbol is randomly selected from a plurality of symbols (i.e., a symbol set) for each of the rotated indicia in step 465. After the indicia stop rotating, and the new symbols are randomly selected, paylines (if any) are identified in the array in step 445. The symbols associated with the indicia forming the payline are evaluated to determine if the resulting symbol combination produces a winning game outcome in step 450. Winning game outcomes receive an award in step 455.

In one embodiment of the wagering game process illustrated in FIG. 18, a symbol is randomly selected for each possible rotational position in which an indicium may stop. For example, in embodiments of the wagering game wherein the indicia may rotate and stop in 90 degree increments, four symbols are randomly selected for each indicium. Each symbol corresponds to one of the four possible rotational increments of the indicium. However, only the symbol corresponding to the rotational position of the indicium is displayed (i.e., only one symbol is displayed at a time).

In one embodiment, during the initial presentation of the game array, prior to displaying the game outcome, the indicia may be initially rotated prior to reaching their stopped rotational position. During this initial rotational period, the randomly selected symbols determined for each of the indicia (in the embodiment discussed above) may be sequentially displayed; the displayed symbol corresponding to the rotational position of the indicia as the indicia rotate. When the indicia stop rotating, the corresponding symbol randomly selected for each of the indicia at that rotational position is displayed. This game feature provides a hint as to the possible game outcome and could be used, in one embodiment, to assist the player in deciding to replay the array with a randomly determined rotation of the indicia (i.e., respinning the array).

For example, in one embodiment, the player may next elect to replay the same game array by respinning the indicia from the previous game outcome. In this embodiment, the replay of the array keeps the original indicia selected. The indicia, however, rotate and change their rotational position. As the indicia rotate into each new incremental rotational position, the symbol on each of the indicia changes to the predetermined randomly selected symbol for that indicium in that rotational position as previously determined for the initial game outcome. When each of the indicia in the array finally reach their randomly selected, stopped rotational position, the corresponding symbol associated with that indicium in that rotational position is displayed and is used to determine any winning game outcomes.

A number of different methods may be used for the determination of symbols for each indicium. In one embodiment, symbols can be randomly selected from a symbol probability table, such as the exemplary table depicted in FIG. 19, in conjunction with a random number generator.

Turning to FIG. 19, an exemplary symbol probability table 1900 is illustrated listing a plurality of symbols forming a symbol set 1922 of potentially selectable symbols 1920. Each of the potentially selectable symbols 1920 in the wagering game are illustrated along with a corresponding random number 1910. In this embodiment, the symbol set 1922 includes all the standard card suits (i.e., spade, club, diamond, and heart) as well as a dollar sign. Any of the symbols contained in the symbol probability table 1900 could potentially be randomly selected by using a random number generator to determine a random number 1910 (between 0 and 4 inclusive) and identifying the corresponding symbol 1920. The randomly selected symbols determined are then associated with each of the indicia in the game array (and in some embodiments, for each of the rotational positions in which the indicia could potentially stop).

Figure 20A:
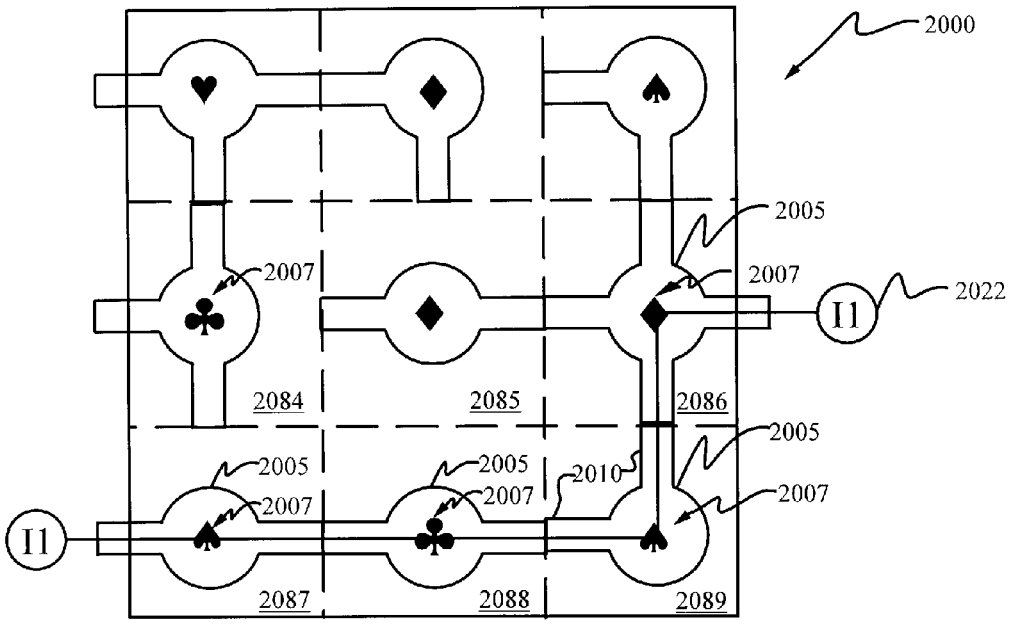
FIG. 20A is an exemplary game outcome for an embodiment of the wagering game before a replay feature is applied to change the rotational position of the indicia and the symbols associated with the indicia.
Figure 20B:
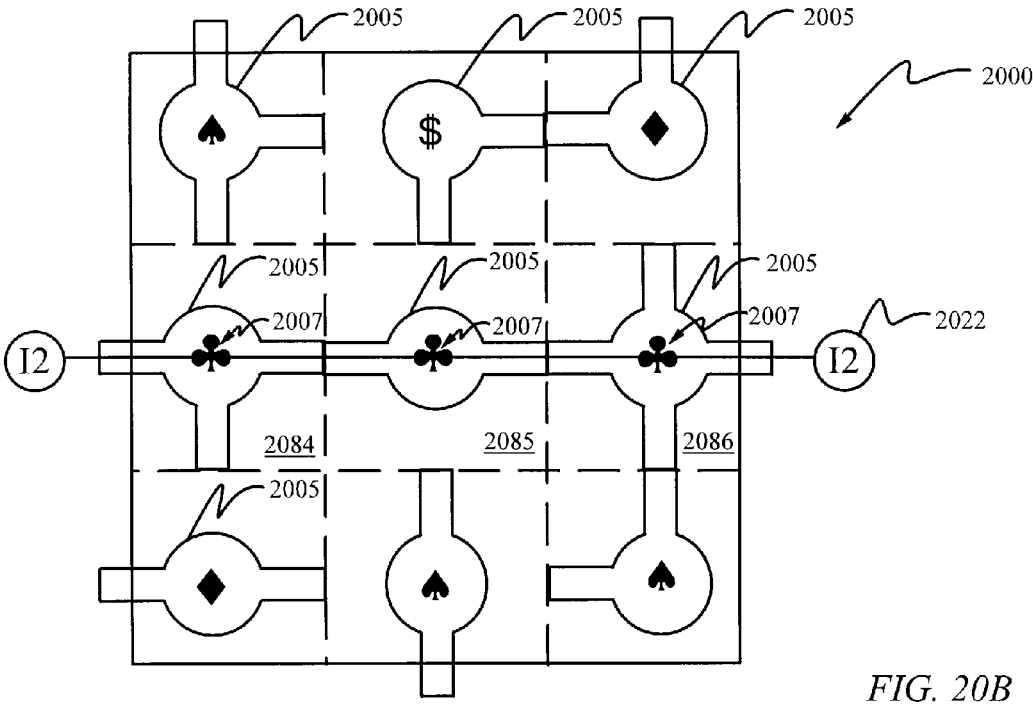
FIG. 20B is an exemplary game outcome received after the replay feature is applied to the array of FIG. 20A changing the rotational position of the indicia and the symbols associated with the indicia.

Turning to FIG. 20A and FIG. 20B, one embodiment of the wagering game is illustrated having an exemplary first game outcome (FIG. 20A) and a replay of the array producing an exemplary second game outcome (FIG. 20B). In this embodiment, after the initial or first game outcome, the player may then either start a new game with new indicia and new symbols or elect to replay the previous game outcome. A replay of the previous game causes the gaming machine to randomly rotate and stop the indicia in a new rotational position and randomly determine new symbols to associate with the indicia.

For both FIG. 20A and FIG. 20B, winning game outcomes are evaluated based on paylines developed by the indicia in the game array. The same payline convention determined for the exemplary embodiment of FIG. 5 will be used for the exemplary embodiment depicted in FIG. 20 (i.e., paylines are formed by indicia linking horizontally across the array without backtracking in the vertical direction of the array). Furthermore, the starting and ending indicia must include a member extending horizontally from the array. In this embodiment, winning game outcomes occur only on paylines having at least three identical symbols.

Turning to FIG. 20A, an initial game outcome is illustrated in which each of the indicia 2005 in the array 2000 have been associated with randomly selected symbols 2007. The members 2010 link adjacent indicia 2005. In this embodiment, the indicia 2005 have been randomly selected from the indicia probability table illustrated in FIG. 12. In addition, in this embodiment, each of the randomly selected symbols 2007 have been randomly selected from the symbol probability table illustrated in FIG. 19.

In addition to the symbols depicted in FIG. 20A, in this embodiment, symbols have also been selected for every other possible stopped rotational position for each indicium. All of these predetermined symbols, and their association to each indicium and indicium rotational position, is the same symbol association used and maintained in connection with the randomly rotated indicia in the replay feature of this embodiment of the wagering game.

As a result of the alignment of the indicia 2005, a payline 2022 (designated I1) has been formed in the array 2000. The payline 2022 is formed from the indicia 2005 in array positions 2087, 2088, 2089, and 2086. The symbols associated with the indicia on this payline include two spades, one diamond, and one club symbol. Consequently, the three identical symbols required for winning the wagering game have not been achieved. However, the player may decide to replay the wagering game based on the favorable production of at least one payline in the initial game outcome or for any other reason.

Turning to FIG. 20B, an exemplary game outcome is depicted resulting from the replay of the game outcome illustrated in array 2000 of FIG. 20A. The exemplary game outcome illustrated in array 2000 of FIG. 20B results from the random rotation of each of the indicia 2005 (i.e., respinning the indicia). The stopped rotational position of each of the indicia can be randomly determined from the table illustrated in FIG. 13 in conjunction with a random number generator. Once the new rotational position of each of the indicia 2005 is determined, the symbol 2007 corresponding to that rotation for each of the indicia can be identified from the predetermined symbols randomly selected for the initial game outcome illustrated in FIG. 20A.

In another embodiment, the symbols used for the replay of the initial game are discarded and new symbols randomly selected from the symbol probability table illustrated in FIG. 18. In this embodiment, the player has no prior knowledge of the symbols associated with the indicia that could potentially be selected during the replay of the array.

As a result of the random rotation of the indicia, a new payline 2022 has been formed (designated I2). This payline designates array positions 2084, 2085, and 2086. In each of these three array positions is a club symbol.

A club symbol was originally displayed in array position 2084 as depicted in FIG. 20A for the first game outcome. Although the rotation of the indicium in array position 2084 has changed the angular orientation of the indicium, the symbol displayed in array position 2084 in FIG. 20B is still a club symbol. This is possible because the random selection of symbols may result in the selection of the same symbol multiple times for the same indicium.

In array position 2085, the original symbol displayed is a diamond symbol as depicted in FIG. 20A. As a result of rotation of the indicium, the new symbol displayed is a club symbol as depicted in array position 2085 of FIG. 20B. This results despite the fact the indicium angular orientation is the same in both FIG. 20A and FIG. 20B. This results because the same angular orientation could result from two different angular rotations of a two-member indicium. As the indicium did not rotate a full 360 degrees (rather, only 180 degrees) this creates the possibility of having a different randomly selected symbol for the 180 degree rotation in contrast to a full 360 degree rotation of the indicium.

Similarly, the diamond symbol originally displayed in array position 2086 in FIG. 20A has also changed despite the same indicium angular orientation in both figures. Again, the indicium in position 2086 has not rotated a full 360 degrees (or a full integer multiplier of 360 degrees) and consequently, may display a different symbol regardless of the indicium's superficially unaltered angular orientation.

As can be observed from FIG. 20B, three identical symbols (i.e., club symbols) are displayed on the payline 2022. This is a winning game outcome in this exemplary wagering game embodiment. Consequently, although the player has lost the initial game outcome illustrated in FIG. 20A, the player has won the replay of the array as illustrated in FIG. 20B.

In another embodiment, the player has the option to either 1) replay the array with rotated indicia and changed symbols or 2) replay the array with only rotated indicia while maintaining the same symbol on each of the indicia. The wager required for these two different replay options may be different.

The wagering games described herein may include a variety of additional game play features. For example, certain indicia may be labeled as wild indicia, allowing that indicia to take on any angular orientation that satisfies the establishment of a winning game outcome. Alternatively, a wild indicium may transform to an indicium having the maximum number of members available for creating linking indicia. For example, a two-member indicium having a wild symbol may transform into a four-member indicium. In still another embodiment, a winning game outcome may cause the indicia on the payline to be removed and replaced with randomly selected indicia, giving the player a second opportunity for another winning game outcome. In addition, the wagering game described herein could also be played as a non-wagering game.

Other embodiments for this wagering game include different graphical methodologies to indicate subsets of indicia in the array. Any graphical method may be used to convey the identification of a subset of indicia in the array. As illustrated in the above embodiments, one graphical methodology to indicate linkage between indicia is to use members that align and make contact with the members of other indicia. For example, in one embodiment, members on adjacent indicia may be lengthened and shortened dependent upon the orientation of the member to the adjacent indicia to facilitate the player's comprehension of the display. In another embodiment, the members may only require general alignment (i.e., no contact between members).

Other methodologies may also be used to indicate a link between indicia. In one embodiment any type of indicator associated with the indicium and observable by the player may be used to establish a subset of indicia. The indicator, in one embodiment, may be, for example, a pointer that conveys to the player a subset of indicia in the array. In one embodiment, this indicator may be rotated about the indicium to directionally select an adjacent indicium.

Although the exemplary arrays illustrated in the various figures are all 3×3, any size array may be formed. For example, the array may be rectangular with any number of rows and columns. Furthermore, the arrays need not be rectangular and can be any geometric shape.

While the invention has been illustrated with respect to several specific embodiments, these embodiments are illustrative rather than limiting. Various modifications and additions could be made to each of these embodiments as will be apparent to those skilled in the art. Accordingly, the invention should not be limited by the above description or of the specific embodiments provided as examples. Rather, the invention should be defined only by the following claims.

The invention claimed is:

1. A method of playing a wagering game on a gaming machine, the gaming machine having a processor for executing a game program, comprising:

recognizing a wager to initiate the wagering game;

forming a first array with indicia assigned to a plurality of array positions, the indicia randomly selected from a plurality of indicium types, each of the indicium types having a different number of members, each of the members for directionally identifying another one of the indicia, each of the indicia having a symbol distinguishable from the indicia, the symbol for each of the indicia randomly selected from a plurality of symbols, wherein each of the indicia have an angular orientation which is randomly selected;

presenting the first array on a display;

identifying a first subset of indicia in the first array, wherein each of the indicia in the first subset mutually directionally identify with at least one other of the indicia in the first subset;

evaluating a first symbol combination formed with the symbol of each of the indicia in the first subset of indicia for a first winning game outcome; and providing a first award for the first winning game outcome.

2. The method of claim 1, further comprising:

replacing the symbol associated with each of the indicia in the second array with another symbol randomly selected from the plurality of symbols;

rotating the indicia in a randomly selected increment to form a second array;

identifying a second subset of indicia in the second array, wherein each of the indicia in the second subset mutually directionally identify with at least one other of the indicia in the second subset;

evaluating a second symbol combination formed with the symbol associated with each of the indicia in the second subset of indicia for a second winning game outcome; and providing a second award for the second winning game outcome.

3. The method of claim 1, wherein the first subset of indicia includes a first indicium and a last indicium, further wherein the first indicium and the last indicium each mutually directionally identify with only one other of the indicia in the first subset of indicia.

4. The method of claim 3, wherein one of the members of both the first indicium and the last indicium extend from the first array.

5. The method of claim 1, wherein each of the indicia in the first subset of indicia are linked together.

6. The method of claim 1, wherein the first subset of indicia is limited to indicia linking from a first indicium to a last indicium, wherein one of the members of both the first indicium and the last indicium extend from the first array.

7. A gaming machine for playing a wagering game, comprising:

a wager acceptor for recognizing a wager;

a video display for displaying the wagering game;

a processor configured for executing a game program operative to:

form a first array with indicia assigned to a plurality of array positions, the indicia randomly selected from a plurality of indicium types, each of the indicium types having a different number of members, each of the members to directionally identify another one of the indicia, each of the indicia further having a symbol distinguishable from the indicia, the symbol for each of the indicia randomly selected from a plurality of symbols, wherein the indicia have an angular orientation which is randomly selected;

identify a first subset of indicia in the first array, wherein each of the indicia in the first subset mutually directionally identify with at least one other of the indicia in the first subset; and evaluate a first symbol combination formed with the symbol of each of the indicia in the first subset of indicia for a first winning game outcome; and a payout mechanism for providing a first award for the first winning game outcome.

8. The gaming machine of claim 7, wherein the processor is further configured to execute the game program operative to:

replace the symbol associated with each of the indicia with another symbol randomly selected from the plurality of symbols;

rotate the indicia in a randomly selected increment to form a second array;

identify a second subset of indicia in the second array, wherein each of the indicia in the second subset mutually directionally identify with at least one other of the indicia in the second subset;

evaluate a second symbol combination formed with the symbol associated with each of the indicia in the second subset of indicia for a second winning game outcome; and provide a second award for the second winning game outcome.

9. The gaming machine of claim 7, wherein the first subset of indicia includes a first indicium and a last indicium, further wherein the first indicium and the last indicium each mutually directionally identify with only one of the indicia in the first subset of indicia.

10. The gaming machine of claim 9, wherein at least one of the members of both the first indicium and the last indicium extend from the first array.

11. The gaming machine of claim 7, wherein the first subset of indicia is limited to the indicia linking from a first indicium to a last indicium, wherein one of the members of both the first indicium and the last indicium extend from the first array.

12. The gaming machine of claim 7, wherein each of the indicia in the first subset of indicia are linked together.

13. A method of playing a wagering game on a gaming machine, the gaming machine having a processor for executing a game program, comprising:

recognizing a wager to initiate the wagering game;

forming a first array with indicia assigned to a plurality of array positions, the indicia randomly selected from a plurality of indicium types, each of the indicium types having a different number of members, each of the members for directionally identifying another one of the indicia, the indicia further having a symbol distinguishable from the indicia, the symbol for each of the indicia randomly selected from a plurality of symbols, wherein each of the indicia have an angular orientation which is randomly selected;

presenting the first array on a display;

identifying a first subset of indicia in the first array, wherein each of the indicia in the first subset of indicia mutually directionally identify with at least one other of the indicia in the first subset;

determining whether the first subset of indicia satisfy a condition to form a first payline;

evaluating a first symbol combination formed with the symbol associated with each of the indicia designated by the first payline for a first winning game outcome; and providing a first award for the first winning game outcome.

14. The method of claim 13, further comprising:

replacing the symbol associated with each of the indicia in the second array with another symbol randomly selected from the plurality of symbols;

rotating the indicia in a randomly selected increment to form a second array;

identifying a second subset of indicia in the second array, wherein each of the indicia in the second subset mutually directionally identify with at least one other of the indicia in the second subset;

determining whether the second subset of indicia satisfy the condition to form a second payline;

evaluating a second symbol combination formed with the symbol associated with each of the indicia designated by the second payline for a second winning game outcome; and providing a second award for the second winning game outcome.

15. The method of claim 13, wherein the first subset of indicia includes a first indicium and a last indicium, the first indicium and the last indicium each mutually directionally identify with only one other of the indicia in the first subset of indicia.

16. The method of claim 13, wherein the condition requires at least one of the members of both the first indicium and the last indicium to extend from the first array.

17. The method of claim 13, wherein the condition limits the first subset of indicia to the indicia linking from a first indicium to a last indicium, wherein one of the members of both the first indicium and the last indicium extend from the first array.

18. A gaming machine for playing a wagering game, comprising:

a wager acceptor for recognizing a wager;

a video display for displaying the wagering game;

a processor configured for executing a game program operative to:

assign indicia to a plurality of array positions to form an array, the indicia randomly selected from a plurality of indicium types, each of the indicium types having a different number of members, each one of the members of the indicia for directionally identifying another one of the indicia in the array, each of the indicia further having a symbol distinguishable from the indicia, wherein the symbol for each of the indicia is randomly selected from a symbol set;

identify a subset of indicia in the array, wherein each one of the indicia in the subset in conjunction with another one of the indicia in the subset directionally identify each other; and evaluate a symbol combination formed with the symbol of each of the indicia in the subset of indicia for a winning game outcome; and a payout mechanism for providing an award for the winning game outcome.

19. The gaming machine of claim 18, wherein the indicia have a randomly determined angular orientation.

20. The gaming machine of claim 18, further wherein each one of the members of the indicia is for directionally identifying another one of the indicia in an adjacent array position.

* * * * *